US010340072B2

(12) United States Patent
Kitajima et al.

(10) Patent No.: US 10,340,072 B2
(45) Date of Patent: Jul. 2, 2019

(54) ELECTRONIC COMPONENT AND METHOD OF MANUFACTURING THE SAME

(71) Applicant: MURATA MANUFACTURING CO., LTD., Kyoto-fu (JP)

(72) Inventors: Masaki Kitajima, Nagaokakyo (JP); Takashi Tomohiro, Nagaokakyo (JP); Gota Shinohara, Nagaokakyo (JP); Hironori Suzuki, Nagaokakyo (JP); Noriko Shimizu, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 376 days.

(21) Appl. No.: 15/204,113

(22) Filed: Jul. 7, 2016

(65) Prior Publication Data

US 2016/0314890 A1 Oct. 27, 2016

Related U.S. Application Data

(63) Continuation of application No. PCT/JP2015/050801, filed on Jan. 14, 2015.

(30) Foreign Application Priority Data

Jan. 31, 2014 (JP) ..... 2014-017433

(51) Int. Cl.
*H01F 27/29* (2006.01)
*H01F 27/255* (2006.01)
(Continued)

(52) U.S. Cl.
CPC ..... *H01F 27/255* (2013.01); *H01F 17/0033* (2013.01); *H01F 27/292* (2013.01);
(Continued)

(58) Field of Classification Search
USPC ..... 336/192
See application file for complete search history.

(56) References Cited

U.S. PATENT DOCUMENTS 6,189,204 B1 2/2001 Shikama et al.
2004/0140877 A1* 7/2004 Nakao ..... H01F 19/08 336/200
(Continued)

FOREIGN PATENT DOCUMENTS

CN 101763933 A 6/2010
CN 103366920 A 10/2013
(Continued)

OTHER PUBLICATIONS

An Office Action; "Decision to Grant a Patent," issued by the Japanese Patent Office on Oct. 31, 2017, which corresponds to Japanese Patent Application No. 2015-559856 and is related to U.S. Appl. No. 15/204,113.
(Continued)

*Primary Examiner* — Elvin G Enad
*Assistant Examiner* — Kazi S Hossain
(74) *Attorney, Agent, or Firm* — Studebaker & Brackett PC

(57) ABSTRACT

An electronic component includes a body made of a material containing particles of a metallic magnetic material, and an outer electrode disposed on a surface of the body. The surface of the body has a contact portion with which the outer electrode is in contact, and the surface of the body includes particles of the metallic magnetic material which are exposed from the surface of the body.

6 Claims, 27 Drawing Sheets

(51) Int. Cl.

| | |
|---|---|
| ***H01F 41/02*** | (2006.01) |
| ***H01F 41/04*** | (2006.01) |
| ***H01F 17/00*** | (2006.01) |

(52) U.S. Cl.
CPC ..... *H01F 41/0206* (2013.01); *H01F 41/0246* (2013.01); *H01F 41/046* (2013.01); *H01F 2017/0066* (2013.01)

(56) References Cited

U.S. PATENT DOCUMENTS

| | | | | |
|---|---|---|---|---|
| 2010/0052838 | A1* | 3/2010 | Matsuta | H01F 17/0013 336/200 |
| 2010/0157565 | A1 | 6/2010 | Yoshida et al. | |
| 2013/0249664 | A1 | 9/2013 | Tonoyama et al. | |
| 2014/0001397 | A1 | 1/2014 | Park et al. | |
| 2014/0002221 | A1* | 1/2014 | Shin | H01F 17/04 336/83 |
| 2014/0132383 | A1 | 5/2014 | Matsuura et al. | |
| 2014/0145814 | A1* | 5/2014 | Lee | H01F 17/0013 336/200 |

FOREIGN PATENT DOCUMENTS

| | | | |
|---|---|---|---|
| CN | 103503088 | A | 1/2014 |
| JP | H08-037250 | A | 2/1996 |
| JP | 2000-012363 | A | 1/2000 |
| JP | 2011-003761 | A | 1/2011 |
| JP | 2011-071457 | A | 4/2011 |
| JP | 2012-028546 | A | 2/2012 |
| JP | 2014-011467 | A | 1/2014 |
| JP | 2014-225590 | A | 12/2014 |

OTHER PUBLICATIONS

International Search Report issued in PCT/JP2015/050801; dated Mar. 10, 2015.
Written Opinion issued in PCT/JP2015/050801; dated Mar. 10, 2015.
International Preliminary Report on Patentability issued in PCT/JP2015/050801; dated Aug. 2, 2016.
An Office Action; "Notice of Reasons for Rejection," issued by the Japanese Patent Office on Jul. 25, 2017, which corresponds to Japanese Patent Application No. 2015-559856 and is related to U.S. Appl. No. 15/204,113; with English language translation.

* cited by examiner

ELECTRONIC COMPONENT AND METHOD OF MANUFACTURING THE SAME

CROSS REFERENCE TO RELATED APPLICATIONS

This application claims benefit of priority to Japanese Patent Application 2014-017433 filed Jan. 31, 2014, and to International Patent Application No. PCT/JP2015/050801 filed Jan. 14, 2015, the entire content of which is incorporated herein by reference.

TECHNICAL FIELD

The present disclosure relates to an electronic component and a method of manufacturing the electronic component, and more particularly, to an electronic component including a body containing particles of a metallic magnetic material and a method of manufacturing the electronic component.

BACKGROUND

An example of known electronic components is a molded coil disclosed in Japanese Unexamined Patent Application Publication No. 2012-28546. In the molded coil disclosed in Japanese Unexamined Patent Application Publication No. 2012-28546, a coil is sealed with a molding magnetic resin in which a resin and magnetic powder are mixed. An outer electrode is formed on a surface of a body made of the molding magnetic resin.

The molded coil disclosed in Japanese Unexamined Patent Application Publication No. 2012-28546 has a problem of insufficient adhesion between the body and the outer electrode.

SUMMARY

In view of this, an object of the present disclosure is to provide an electronic component that enables adhesion between the body and the outer electrode to be improved and a method of manufacturing the electronic component.

Solution to Problem

An electronic component according to an embodiment of the present disclosure includes a body made of a material containing particles of a metallic magnetic material, and an outer electrode disposed on a surface of the body. The surface of the body has a contact portion with which the outer electrode is in contact, and the contact portion includes particles of the metallic magnetic material which are exposed from the surface of the body.

A method of manufacturing an electronic component according to an embodiment of the present disclosure includes a body making step of making a mother body in which plural bodies made of a material containing particles of a metallic magnetic material are disposed in a matrix arrangement, a groove forming step of forming a groove that extends from one main surface of the mother body and that does not reach the other main surface of the mother body, an electrode forming step of forming an outer electrode on an inner circumferential surface of the groove, and a dividing step of dividing the mother body into the plural bodies.

According to the present disclosure, adhesion between the body and the outer electrode can be improved.

DETAILED DESCRIPTION

An electronic component according to an embodiment and a method of manufacturing the electronic components will hereinafter be described.

(Structure of Electronic Component)

Figure 1:
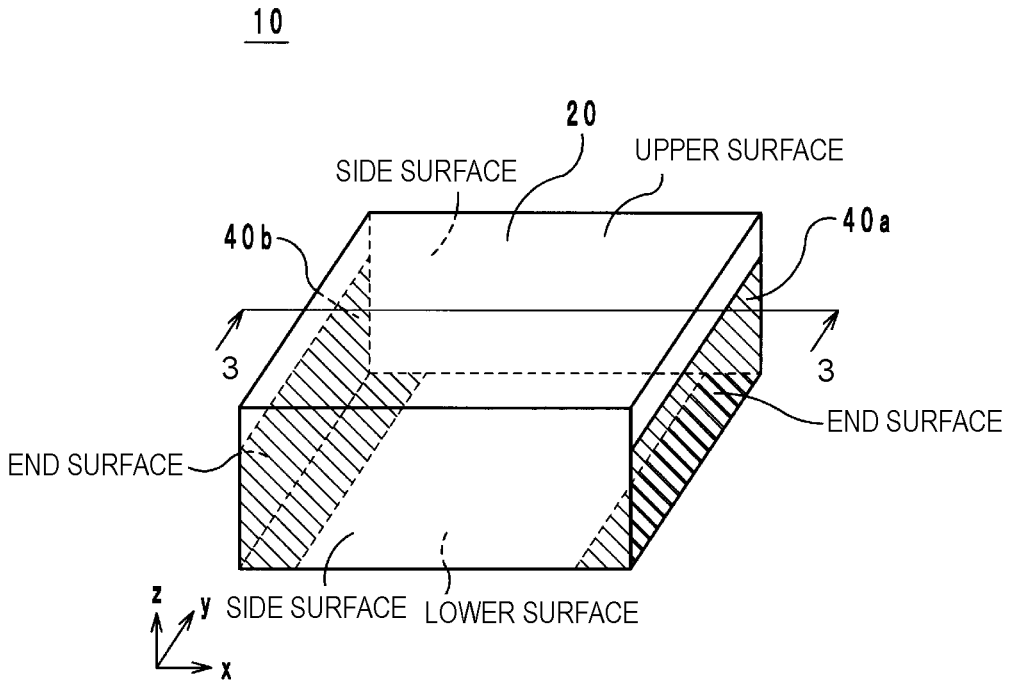
FIG. 1 is a perspective view of the appearance of an electronic component 10 according to an embodiment.
Figure 2:
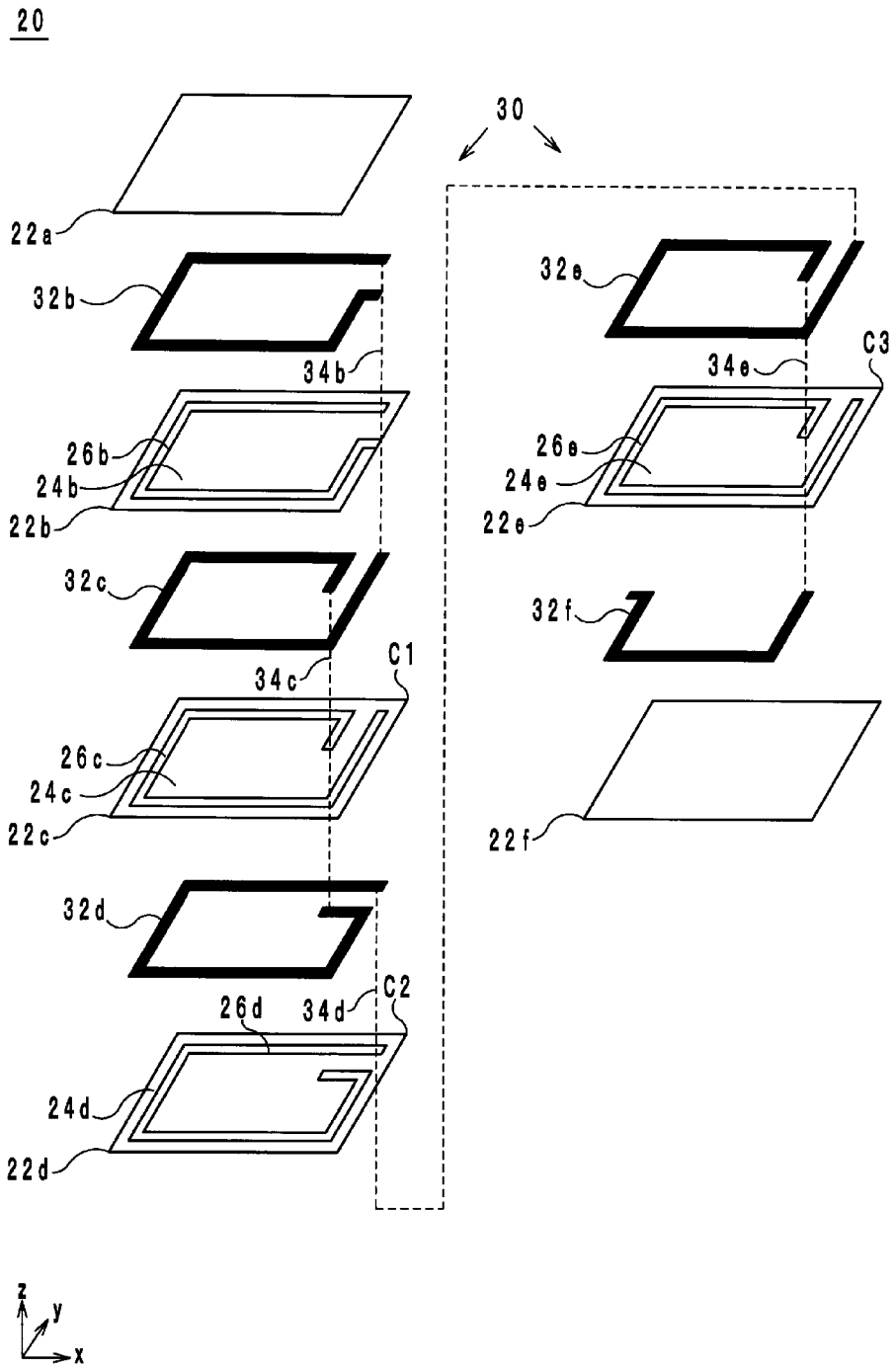
FIG. 2 is an exploded perspective view of a multilayer body 20 of the electronic component 10.
Figure 3:
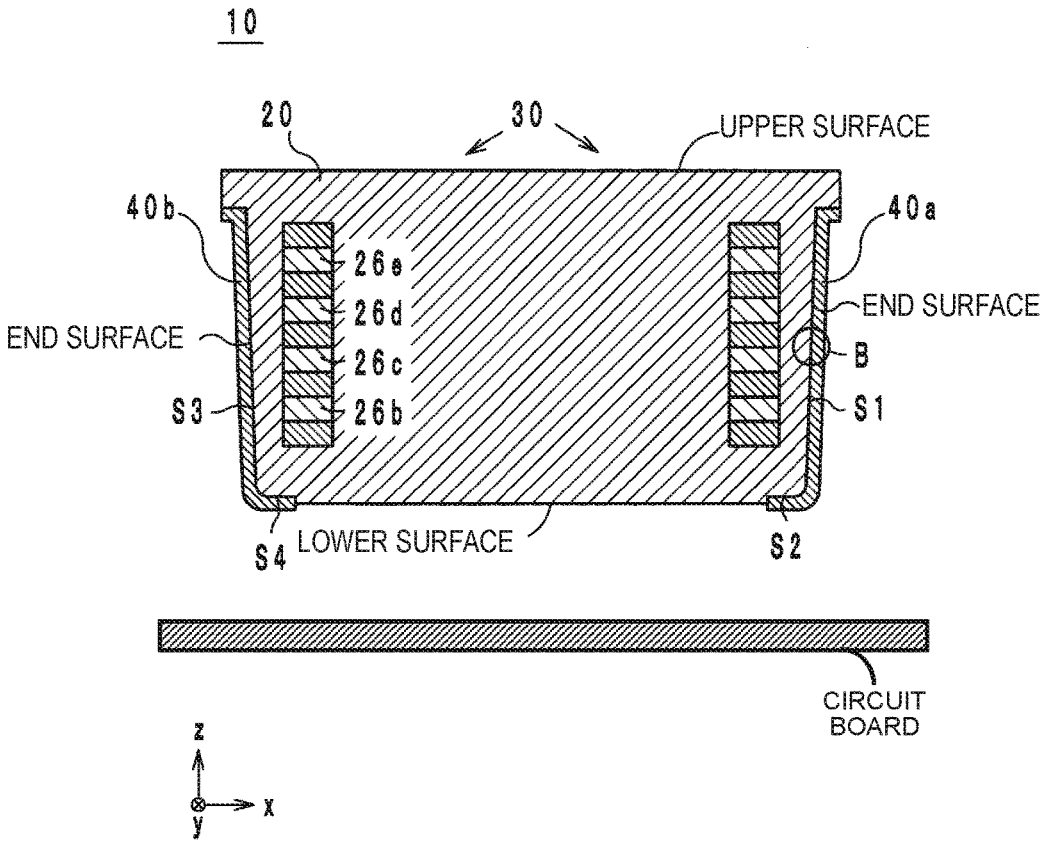
FIG. 3 is a sectional view of the structure of the electronic component 10 taken along line 3-3.
Figure 4:
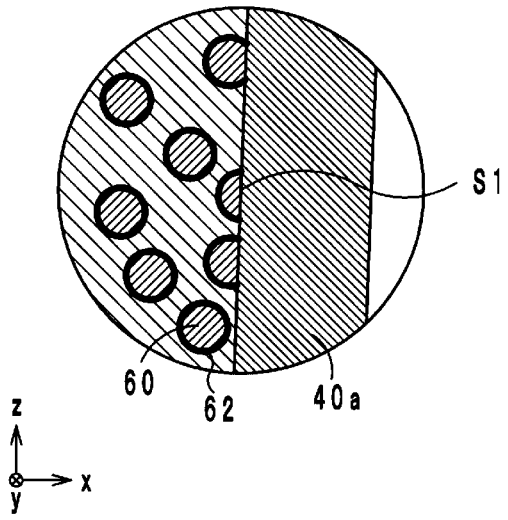
FIG. 4 is an enlarged view of a boundary B between the multilayer body 20 and an outer electrode 40*a* in FIG. 3.

The structure of the electronic component according to the embodiment will now be described with reference to the drawings. FIG. 1 is a perspective view of the appearance of an electronic component 10 according to the embodiment. FIG. 2 is an exploded perspective view of a multilayer body 20 of the electronic component 10. FIG. 3 is a sectional view of the structure of the electronic component 10 taken along line 3-3. FIG. 4 is an enlarged view of a boundary B between the multilayer body 20 and an outer electrode 40*a* in FIG. 3.

In the following description, the direction in which the electronic component 10 is laminated is defined as a z-axis direction, and in plan view from the z-axis direction, the direction parallel to the long sides of the electronic component is defined as an x-axis direction and the direction parallel to the short sides of the electronic component is defined as a y-axis direction. A surface on the positive side in the z-axis direction is referred to as an upper surface, and a surface on the negative side in the z-axis direction is referred to as a lower surface. Two opposing surfaces in the x-axis direction are referred to as end surfaces, and two opposing surfaces in the y-axis direction are referred to as side surfaces. The x-axis, the y-axis, and the z-axis are perpendicular to one another.

The electronic component 10 includes the multilayer body 20, a coil 30, the outer electrode 40*a* and an outer electrode 40*b*. As illustrated in FIG. 1, the electronic component 10 has a rectangular cuboid shape.

In the multilayer body 20, insulating layers 22*a* to 22*f* are laminated so as to be arranged in this order from the positive side in the z-axis direction. The multilayer body 20 has a rectangular cuboid shape. As illustrated in FIG. 3, however, the end surface on the negative side in the x-axis direction is slightly inclined in plan view from the y-axis direction so as to extend toward the negative side in the x-axis direction while extending toward the positive side in the z-axis direction. In addition, the end surface on the positive side in the x-axis direction is slightly inclined in plan view from the y-axis direction so as to extend toward the positive side in the x-axis direction while extending toward the positive side in the z-axis direction. In FIG. 1, the inclination of the end surfaces is not illustrated.

The insulating layers 22*a* to 22*f* are rectangular in plan view from the z-axis direction. The insulating layers 22*a* to 22*f* are each made of a resin containing particles of a metallic magnetic material. The metallic magnetic material is, for example, an Fe—Si—Cr alloy or Fe (carbonyl). The surfaces of the particles of the metallic magnetic material are coated with respective insulating films (for example, glass, or phosphate). The resin is, for example, an epoxy resin.

As illustrated in FIG. 2, the insulating layer 22*a* is located on the most positive side in the z-axis direction in the multilayer body 20. The insulating layer 22*a* is made of a magnetic material.

The insulating layer 22*b* is adjacent to the insulating layer 22*a* on the negative side in the z-axis direction. The insulating layer 22*b* is formed of a magnetic material layer 24*b* made of a magnetic material and a non-magnetic material layer 26*b* made of a non-magnetic material. The non-magnetic material layer 26*b* is a belt-like non-magnetic material layer disposed parallel to the outer edge of the insulating layer 22*b*. In plan view from the z-axis direction, the non-magnetic material layer 26*b* has a frame shape that is a rectangular shape part of which is removed. In plan view from the z-axis direction, the magnetic material layer 24*b* is disposed around the non-magnetic material layer 26*b* and inside the non-magnetic material layer 26*b*.

The insulating layer 22*c* is adjacent to the insulating layer 22*b* on the negative side in the z-axis direction. The insulating layer 22*c* is formed of a magnetic material layer 24*c* made of a magnetic material and a non-magnetic material layer 26*c* made of a non-magnetic material. The non-magnetic material layer 26*c* is a belt-like non-magnetic material layer disposed parallel to the outer edge of the insulating layer 22*c*. In plan view from the z-axis direction, the non-magnetic material layer 26*c* has a frame shape that is a rectangular shape part of which is removed. In plan view from the z-axis direction, the magnetic material layer 24*c* is disposed around the non-magnetic material layer 26*c* and inside the non-magnetic material layer 26*c*.

The insulating layer 22*d* is adjacent to the insulating layer 22*c* on the negative side in the z-axis direction. The insulating layer 22*d* is formed of a magnetic material layer 24*d* made of a magnetic material and a non-magnetic material layer 26*d* made of a non-magnetic material. The non-magnetic material layer 26*d* is a belt-like non-magnetic material layer disposed parallel to the outer edge of the insulating layer 22*d*. In plan view from the z-axis direction, the non-magnetic material layer 26*d* has a frame shape that is a rectangular shape part of which is removed. In plan view from the z-axis direction, the magnetic material layer 24*d* is disposed around the non-magnetic material layer 26*d* and inside the non-magnetic material layer 26*d*.

The insulating layer 22*e* is adjacent to the insulating layer 22*d* on the negative side in the z-axis direction. The insulating layer 22*e* is formed of a magnetic material layer 24*e* made of a magnetic material and a non-magnetic material layer 26*e* made of a non-magnetic material. The non-magnetic material layer 26*e* is a belt-like non-magnetic material layer disposed parallel to the outer edge of the insulating layer 22*e*. In plan view from the z-axis direction, the non-magnetic material layer 26*e* has a frame shape that is a rectangular shape part of which is removed. In plan view from the z-axis direction, the magnetic material layer 24*e* is disposed around the non-magnetic material layer 26*e* and inside the non-magnetic material layer 26*e*.

The insulating layer 22*f* is located on the most negative side in the z-axis direction in the multilayer body 20. The insulating layer 22*f* is made of a magnetic material.

Thus, in plan view from the z-axis direction, the non-magnetic material layers 26*b* to 26*e* overlap one another and extend so as to define a rectangular path.

As illustrated in FIG. 2, the coil 30 is located inside the multilayer body 20 and includes coil conductors 32*b* to 32*f* and via conductors 34*b* to 34*e*. The coil 30 has a helical shape whose central axis is parallel to the z-axis. More specifically, in plan view from the positive side in the z-axis direction, the coil 30 has a helical shape such that the coil 30 extends from the positive side to the negative side in the z-axis direction while being curved clockwise. The material of the coil 30 is a conductive material such as Au, Ag, Pd, Cu, or Ni.

The coil conductor 32*b* is a line conductor disposed along the non-magnetic material layer 26*b*. Accordingly, in plan view from the z-axis direction, the coil conductor 32*b* has a frame shape that is a rectangular shape part of which is removed as in the case of the non-magnetic material layer 26*b*. The coil conductor 32*b* matches with and overlaps the non-magnetic material layer 26*b*. One end of the coil conductor 32*b* extends beyond the outer edge of the insulating layer 22*b* on the positive side in the x-axis direction and is exposed from the end surface of the multilayer body 20 on the positive side in the x-axis direction. Near a corner between the outer edge of the insulating layer 22*b* on the positive side in the x-axis direction and the outer edge of the insulating layer 22*b* on the positive side in the y-axis direction, the other end of the coil conductor 32*b* is connected to the via conductor 34*b* extending through the insulating layer 22*b* in the z-axis direction.

The coil conductor 32*c* is a line conductor disposed along the non-magnetic material layer 26*c*. Accordingly, in plan view from the z-axis direction, the coil conductor 32*c* has a frame shape that is a rectangular shape part of which is removed as in the case of the non-magnetic material layer 26*c*. The coil conductor 32*c* matches with and overlaps the non-magnetic material layer 26*c*. Near a corner C1 between the outer edge of the insulating layer 22*c* on the positive side in the x-axis direction and the outer edge of the insulating layer 22*c* on the positive side in the y-axis direction, one end of the coil conductor 32*c* is connected to the via conductor 34*b*. The other end of the coil conductor 32*c* is connected to the via conductor 34*c* that is located at a position away from the one end of the coil conductor 32*c* near the corner C1 toward the center of the insulating layer 22*c* and that extends through the insulating layer 22*c* in the z-axis direction.

The coil conductor 32*d* is a line conductor disposed along the non-magnetic material layer 26*d*. Accordingly, in plan view from the z-axis direction, the coil conductor 32*d* has a frame shape that is a rectangular shape part of which is removed as in the case of the non-magnetic material layer 26*d*. The coil conductor 32*d* matches with and overlaps the non-magnetic material layer 26*d*. Near a corner C2 between the outer edge of the insulating layer 22*d* on the positive side in the x-axis direction and the outer edge of the insulating layer 22*d* on the positive side in the y-axis direction, one end of the coil conductor 32*d* is connected to the via conductor 34*c*. The other end of the coil conductor 32*d* is connected to the via conductor 34*d* that is located at a position away from the one end of the coil conductor 32*d* toward the outer edge of the insulating layer 22*d* near the corner C2 and that extends through the insulating layer 22*d* in the z-axis direction.

The coil conductor 32*e* is a line conductor disposed along the non-magnetic material layer 26*e*. Accordingly, in plan view from the z-axis direction, the coil conductor 32*e* has a frame shape that is a rectangular shape part of which is removed as in the case of the non-magnetic material layer 26*e*. The coil conductor 32*e* matches with and overlaps the non-magnetic material layer 26*e*. Near a corner C3 between the outer edge of the insulating layer 22*e* on the positive side in the x-axis direction and the outer edge of the insulating layer 22*e* on the positive side in the y-axis direction, one end of the coil conductor 32*e* is connected to the via conductor 34*d*. The other end of the coil conductor 32*e* is connected to the via conductor 34*e* that is located at a position away from the one end of the coil conductor 32*e* near the corner C3 toward the center of the insulating layer 22*e* and that extends through the insulating layer 22*e* in the z-axis direction.

The coil conductor 32*f* has an angular U-shape in plan view from the z-axis direction. The coil conductor 32*f* is a line conductor disposed along the outer edges of the insulating layer 22*f* on the positive and negative sides in the x-axis direction and the outer edge of the insulating layer 22*f* on the negative side in the y-axis direction. Near a corner between the outer edge of the insulating layer 22*f* on the positive side in the x-axis direction and the outer edge of the insulating layer 22*f* on the positive side in the y-axis direction, one end of the coil conductor 32*f* is connected to the via conductor 34*e*. The other end of the coil conductor 32*f* extends beyond the outer edge of the insulating layer 22*f* on the negative side in the x-axis direction and is exposed from the end surface of the multilayer body 20 on the negative side in the x-axis direction.

Thus, in plan view from the z-axis direction, the coil conductors 32*b* to 32*f* overlap one another and extend along the rectangular path defined by the non-magnetic material layers 26*b* to 26*e*. The coil conductors 32*b* to 32*f* and the non-magnetic material layers 26*b* to 26*f* alternate in the z-axis direction.

As illustrated in FIG. 1, the outer electrodes 40*a* and 40*b* are metallic external terminals disposed on surfaces of the multilayer body 20. More specifically, the outer electrode 40*a* extends into the lower surface of the multilayer body 20 and the end surface of the multilayer body 20 on the positive side in the x-axis direction that is adjacent to the lower surface. The outer electrode 40*a*, however, covers only a portion near the short side of the lower surface of the multilayer body 20 on the positive side in the x-axis direction. The outer electrode 40*a* does not cover a portion near a side, on the positive side in the z-axis direction, of the end surface on the positive side in the x-axis direction. The outer electrode 40*a* is thus connected to the one end of the coil conductor 32*b*. The outer electrode 40*b* extends into the lower surface of the multilayer body 20 and the end surface of the multilayer body 20 on the negative side in the x-axis direction that is adjacent to the lower surface. The outer electrode 40*b*, however, covers only a portion near the short side of the lower surface of the multilayer body 20 on the negative side in the x-axis direction. The outer electrode 40*b* does not cover a portion near a side, on the positive side in the z-axis direction, of the end surface on the negative side in the x-axis direction. The outer electrode 40*b* is thus connected to the other end of the coil conductor 32*f*. Consequently, the coil 30 is electrically connected to the outer electrodes 40*a* and 40*b*. The outer electrodes 40*a* and 40*b* are made of Cu, Ag, or an alloy of Cu and Ag.

As illustrated in FIG. 4, particles 60 of the metallic magnetic material are exposed from the surfaces of the multilayer body 20 at contact portions S1 and S2 (see FIG. 3) at which the outer electrode 40*a* is in contact with the surfaces of the multilayer body 20. The contact portion S1 is a portion at which the outer electrode 40*a* is in contact with the end surface of the multilayer body 20 on the positive side in the x-axis direction. The contact portion S2 is a portion at which the outer electrode 40*a* is in contact with the lower surface of the multilayer body 20.

As illustrated in FIG. 3, the contact portion S1 is inclined so as to extend toward the positive side in the x-axis direction while extending toward the positive side in the z-axis direction. The reason is that the end surface (more precisely, the contact portion S1) of the multilayer body 20 on the positive side in the x-axis direction is a surface formed when a mother multilayer body is cut with a dicing machine as described later. For this reason, as illustrated in FIG. 4, the particles 60 of the metallic magnetic material located at the end surface of the multilayer body 20 on the positive side in the x-axis direction are each in the form of a truncated sphere. Accordingly, insulating films 62 with which the surfaces of the particles 60 of the metallic magnetic material are coated are also removed. The particles 60 of the metallic magnetic material are consequently exposed at the contact portion S1 and are in contact with the outer electrode 40*a*.

As illustrated in FIG. 3, the contact portion S2 is formed by cutting part of the lower surface of the multilayer body 20. More specifically, the contact portion S2 is a belt-like region extending along the short side of the lower surface of the multilayer body 20 on the positive side in the x-axis direction. The region is cut with a dicing machine as described later, and the contact portion S2 is consequently located at a position slightly away from a portion of the lower surface of the multilayer body 20 other than the contact portion S2 toward the positive side in the z-axis direction. For this reason, the particles 60 of the metallic magnetic material located at the contact portion S2 are each in the form of a truncated sphere. Accordingly, the insulating films 62 with which the surfaces of the particles 60 of the metallic magnetic material are coated are also removed. The particles 60 of the metallic magnetic material are consequently exposed at the contact portion S2 and are in contact with the outer electrode 40*a*.

As illustrated in FIG. 4, the particles 60 of the metallic magnetic material are exposed from the surfaces of the multilayer body 20 at contact portions S3 and S4 (see FIG. 3) at which the outer electrode 40*b* is in contact with the surfaces of the multilayer body 20. The contact portion S3 is a portion at which the outer electrode 40*b* is in contact with the end surface of the multilayer body 20 on the negative side in the x-axis direction. The contact portion S4 is a portion at which the outer electrode 40*b* is in contact with the lower surface of the multilayer body 20. The description of the contact portions S3 and S4 is substantially the same as the contact portions S1 and S2 and is accordingly omitted.

The electronic component 10 configured as above is mounted such that the lower surface of the multilayer body 20 faces a circuit board. In other words, the lower surface of the multilayer body 20 is a mounting surface.

(Method of Manufacturing Electronic Component)

A method of manufacturing the electronic components 10 will now be described. FIG. 5 to FIG. 27 are sectional views illustrating steps when the electronic components 10 are manufactured.

First, a thermosetting resin sheet (hereinafter, referred to as a resin sheet) 260*f* containing a filler is prepared. Examples of the filler contained in the resin sheet 260*f* include insulating fine particles such as silica particles, silicon carbide particles, and alumina particles. An example of the main component of the resin is an epoxy resin.

Figure 5:
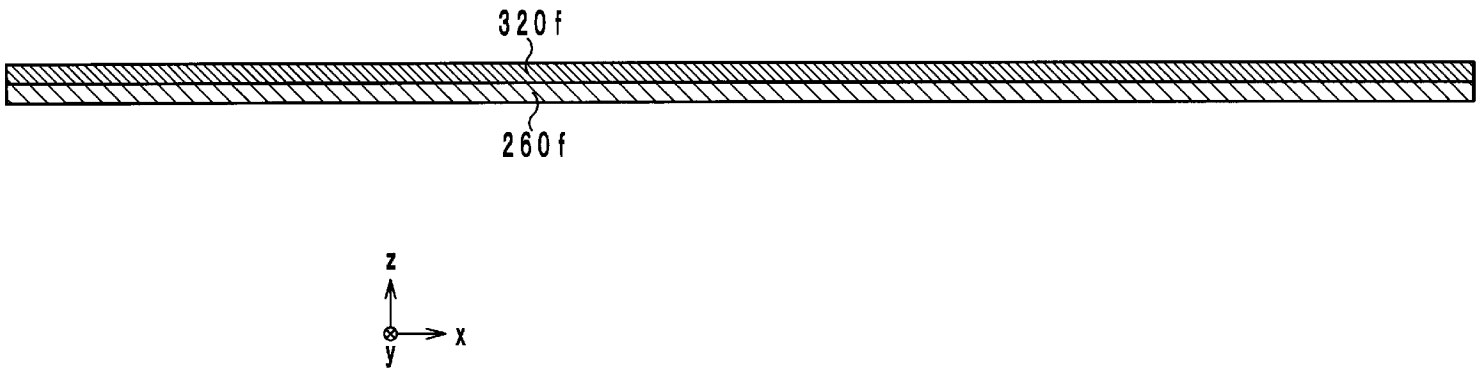
FIG. 5 is a sectional view illustrating a step when the electronic components 10 are manufactured.

As illustrated in FIG. 5, a Cu foil 320*f* is subsequently placed on the resin sheet 260*f* and the Cu foil 320*f* and the resin sheet 260*f* are bonded together by pressure bonding. At this time, a vacuum heating and pressing apparatus is preferably used to remove gas at the boundary between the resin sheet 260*f* and the Cu foil 320*f* at the same time. The conditions of pressure bonding are that, for example, vacuuming is performed at temperatures of 90 to 200° C. for 1 to 30 minutes and pressing is performed at 0.5 to 10 MPa for 1 to 120 minutes. The pressure bonding can be performed by a roller pressing method or a hot pressing method.

After pressure bonding, a heat treatment is performed to cure the resin sheet 260*f*. The heat treatment is performed, for example, at temperatures of 130 to 200° C. for 10 to 120 minutes by using a high-temperature chamber such as an oven.

After heat treatment, electrolytic Cu plating is performed to adjust the thickness of the Cu foil 320*f* bonded by pressure bonding. More specifically, the resin sheet 260*f* to which the Cu foil 320*f* has been bonded by pressure bonding is immersed in an acid cleaner before plating, and an oxide film on the Cu foil 320*f* is removed. The electrolytic Cu plating is subsequently performed on the Cu foil in a constant current mode by using a plating bath whose main component is a copper sulfate solution. After electrolytic Cu plating, rinsing and drying are performed. A heat treatment is then performed, for example, at temperatures of 150 to 250° C. for 60 to 180 minutes by using a high-temperature chamber such as an oven in order to suppress warping of a substrate after plating. In this step, a vapor deposition method or a sputtering method may be used instead of electrolytic Cu plating.

Figure 6:
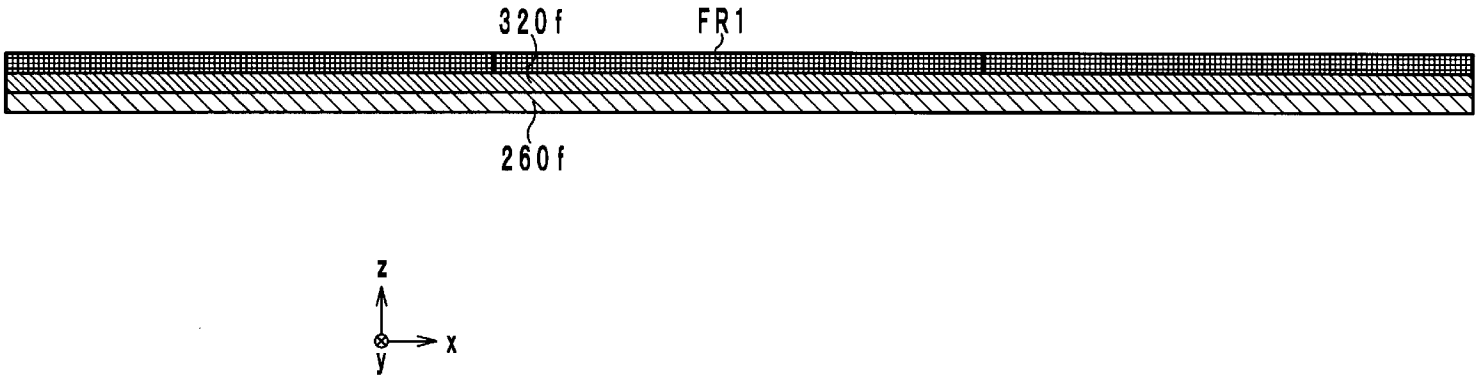
FIG. 6 is a sectional view illustrating a step when the electronic components 10 are manufactured.
Figure 7:
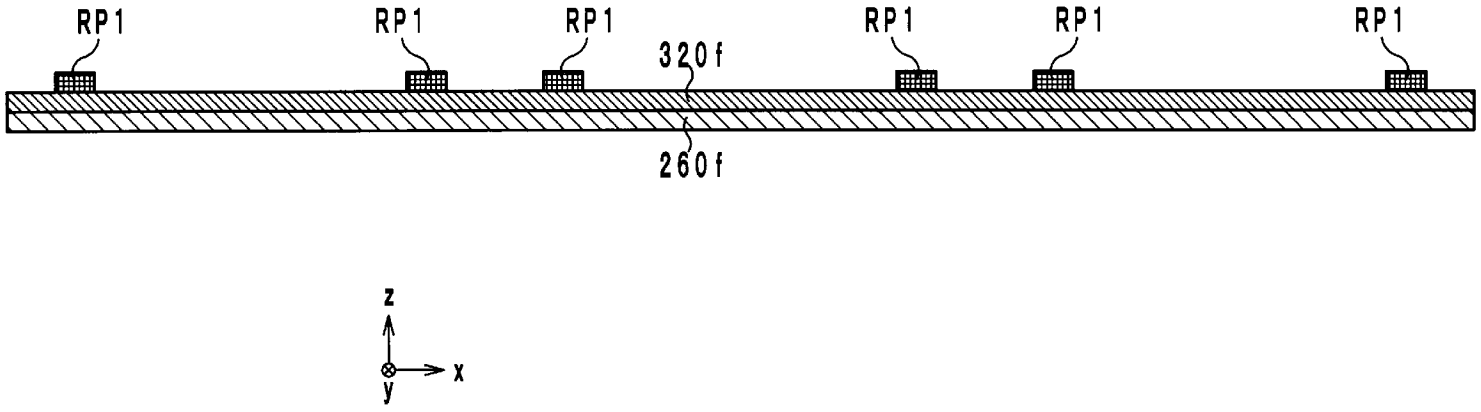
FIG. 7 is a sectional view illustrating a step when the electronic components 10 are manufactured.

A resist pattern RP1 is formed on the Cu foil 320*f* whose thickness has been adjusted. In a step of forming the resist pattern RP1, a surface of the Cu foil 320*f* is roughened with a buffing machine in order to improve adhesion between the resist pattern RP1 and the Cu foil 320*f*, and the surface of the Cu foil 320*f* is rinsed and dried. In the roughening process, a milling method or an etching method may be used. As illustrated in FIG. 6, a film resist FR1 is laminated on the Cu foil 320*f*. The film resist FR1 is exposed to light through a film mask and the film resist exposed to the light is thereby cured. After the film resist FR1 is cured, developing is performed by using a sodium carbonate developing solution and uncured portions of the film resist FR1 are removed. Thus, the resist pattern RP1, as illustrated in FIG. 7, is formed on the Cu foil 320*f*. Rinsing and drying are subsequently performed to remove the developing solution.

Figure 8:
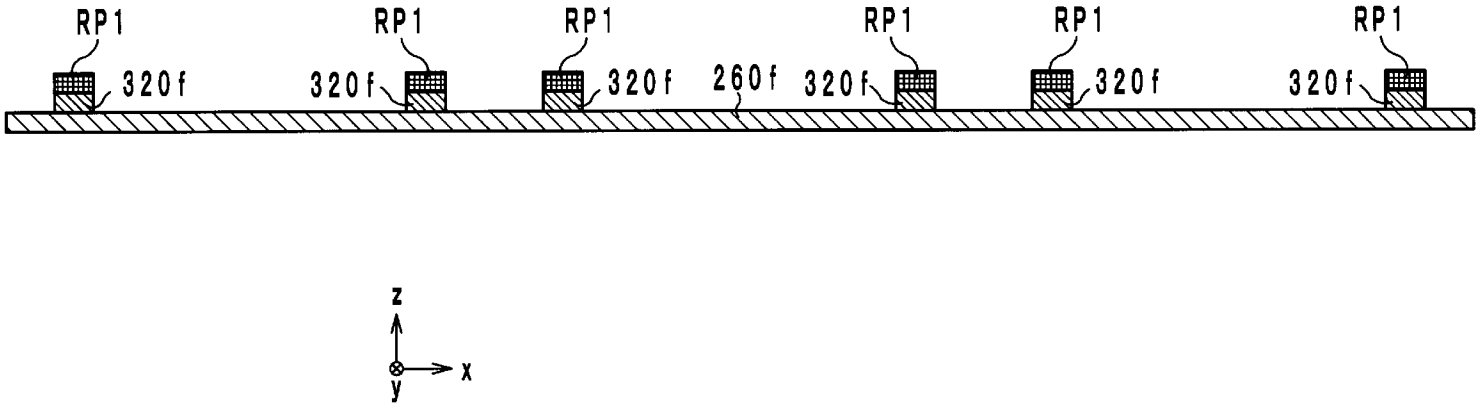
FIG. 8 is a sectional view illustrating a step when the electronic components 10 are manufactured.
Figure 9:
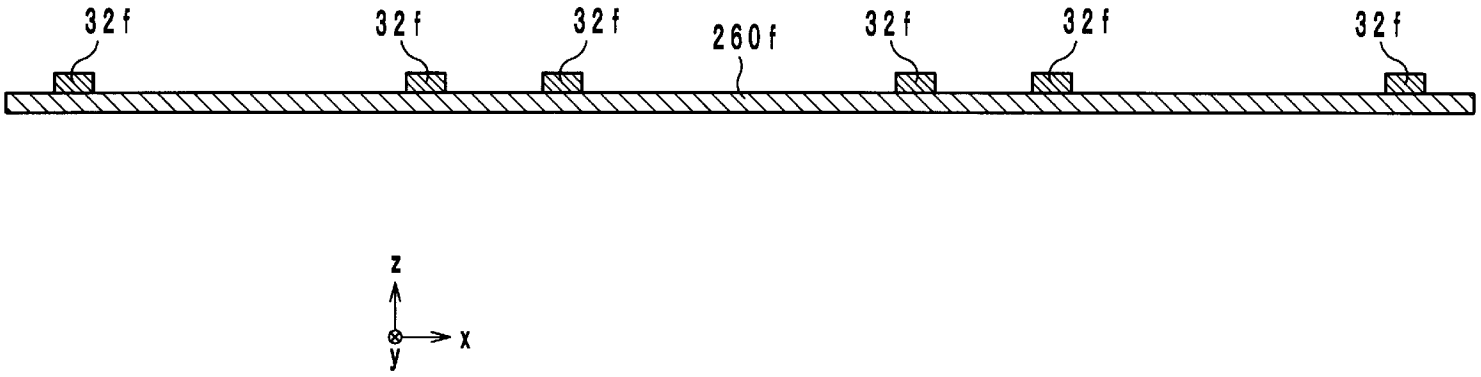
FIG. 9 is a sectional view illustrating a step when the electronic components 10 are manufactured.

The Cu foil 320*f* on which the resist pattern RP1 has been formed is etched by wet etching, and, as illustrated in FIG. 8, portions of the Cu foil 320*f* that are not covered by the resist pattern RP1 are removed. At this time, milling, for example, may be used instead of wet etching. Rinsing is subsequently performed to remove residues of a solution used for wet etching. The resist pattern RP1 on the Cu foil 320*f* is stripped by using a stripping solution. Residues of the stripping solution are then removed by rinsing and drying is performed. As illustrated in FIG. 9, in this step, a conductor pattern corresponding to the coil conductors 32*f* of the electronic components 10 is formed on the resin sheet 260*f*.

Figure 10:
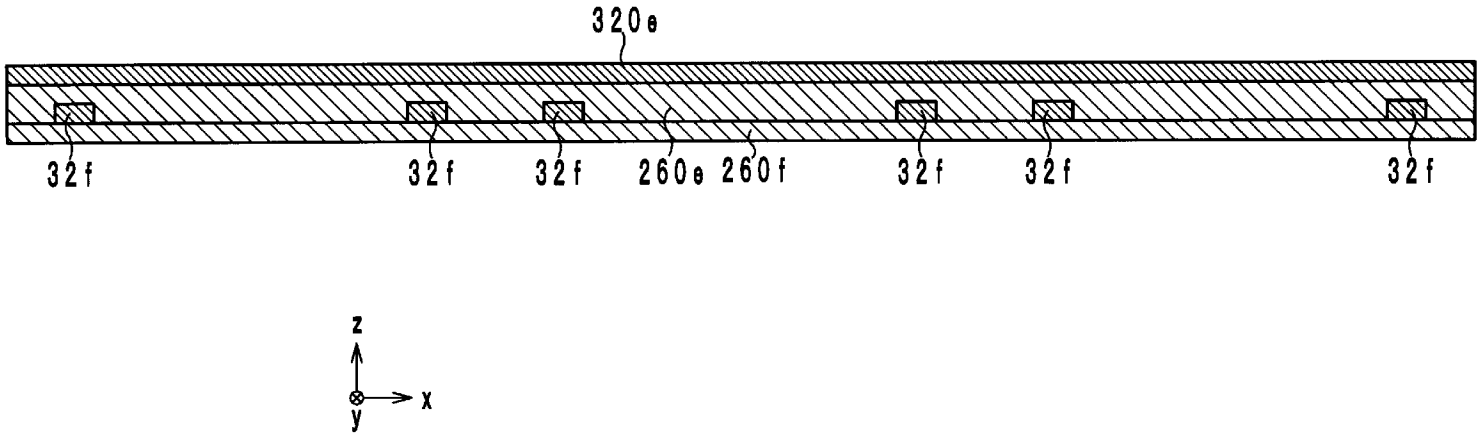
FIG. 10 is a sectional view illustrating a step when the electronic components 10 are manufactured.

As illustrated in FIG. 10, a resin sheet 260*e* to which a Cu foil 320*e* has been bonded by pressure bonding is placed on the resin sheet 260*f* on which the conductor pattern has been formed, and the resin sheet 260*e* is bonded thereto by pressure bonding. The conditions of pressure bonding are that vacuuming is performed at temperatures of 90 to 200° C. for 1 to 30 minutes by using a vacuum heating and pressing apparatus and pressing is performed at 0.5 to 10 MPa for 1 to 120 minutes in the same manner as above. At this time, a spacer for regulating the degree of pressure bonding may be used to adjust the thickness of the entire resin sheet laminated and bonded by pressure bonding. The resin sheet 260*e* bonded by pressure bonding in this step will be the non-magnetic material layers 26*e* of the electronic components 10 and the Cu foil 320*e* will be the coil conductors 32*e*. In this step, the resin sheet 260*e* may be bonded, by pressure bonding, onto the resin sheet 260*f* on which the conductor pattern has been formed, and the Cu foil 320*e* may be bonded onto the resin sheet 260*e* by pressure bonding.

Figure 11:
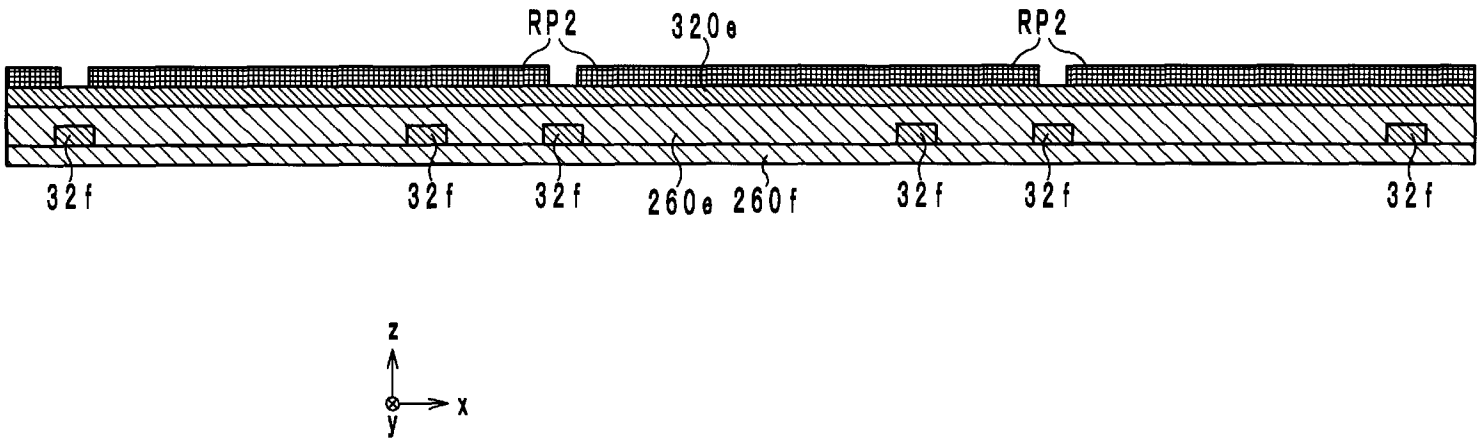
FIG. 11 is a sectional view illustrating a step when the electronic components 10 are manufactured.
Figure 12:
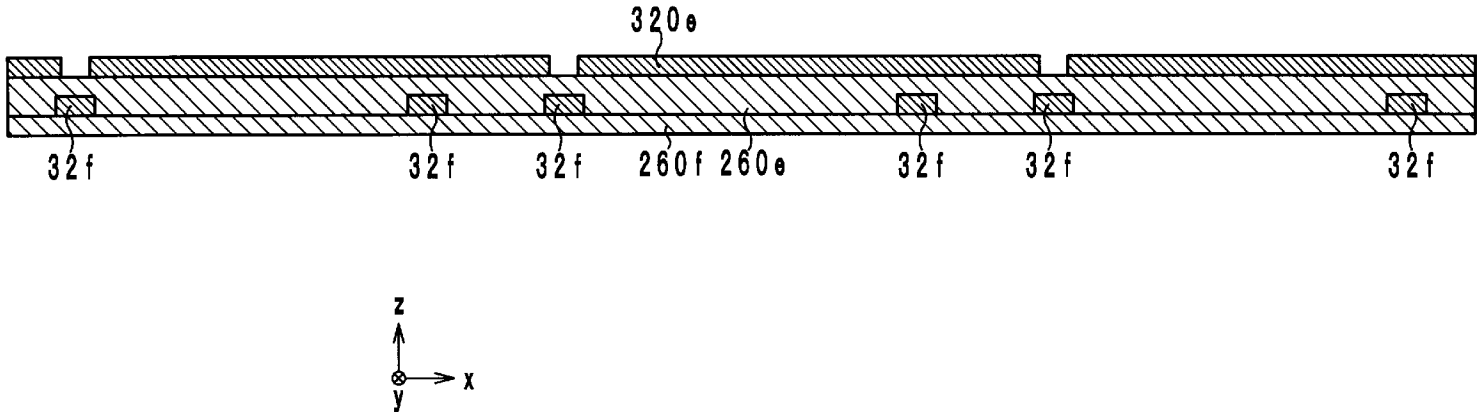
FIG. 12 is a sectional view illustrating a step when the electronic components 10 are manufactured.
Figure 13:
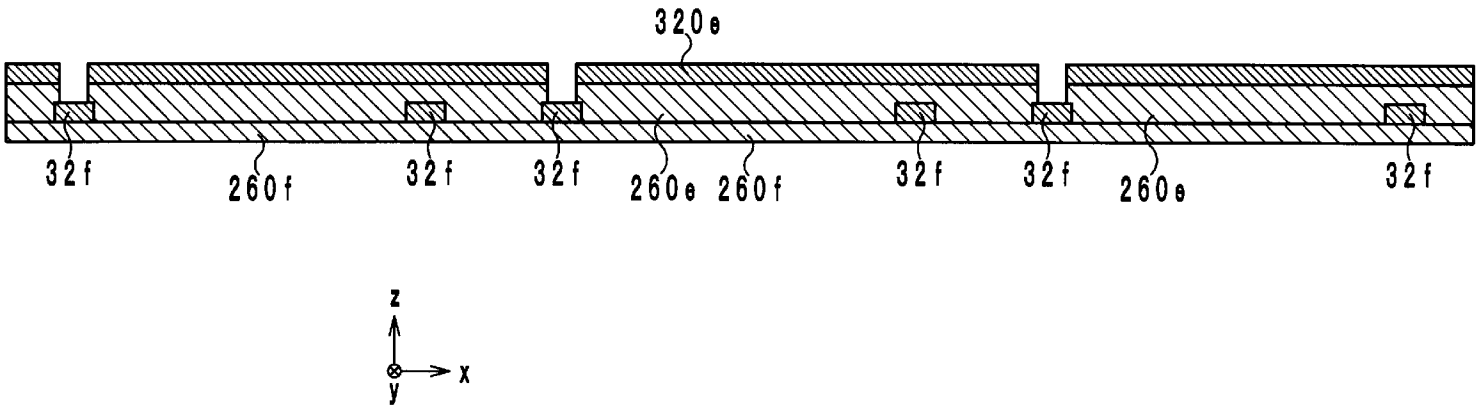
FIG. 13 is a sectional view illustrating a step when the electronic components 10 are manufactured.

Vias are formed in the Cu foil 320*e* and the resin sheet 260*e* bonded together by pressure bonding in the previous step. In a step of forming the vias, as illustrated in FIG. 11, a resist pattern RP2 is formed on the Cu foil 320*e*. The resist pattern RP2 is formed by performing roughening of a surface of the Cu foil 320*e*, laminating of the film resist, exposing through the film mask, and developing in this order. The Cu foil 320*e* on which the resist pattern RP2 has been formed is subsequently etched by wet etching, and the resist pattern RP2 is removed after etching. As illustrated in FIG. 12, parts of the vias are thus formed in the Cu foil 320*e*. Portions at which the Cu foil 320*e* is removed by etching and the resin sheet 260*e* is exposed are irradiated with a laser beam, and the vias extending through the Cu foil 320*e* and the resin sheet 260*e*, as illustrated in FIG. 13, are thereby formed. The vias may be formed by drilling, dissolving, or blasting. However, in the case where the vias are formed in the resin sheet 260*e* by a laser beam, formation of an unnecessary via in the Cu foil can be suppressed because Cu foil reflects a laser beam. Furthermore, a de-smearing process is performed to remove a smear produced when the vias are formed. The specific conditions of forming the resist pattern and etching are the same as in the case of the Cu foil 320*f*.

Figure 14:
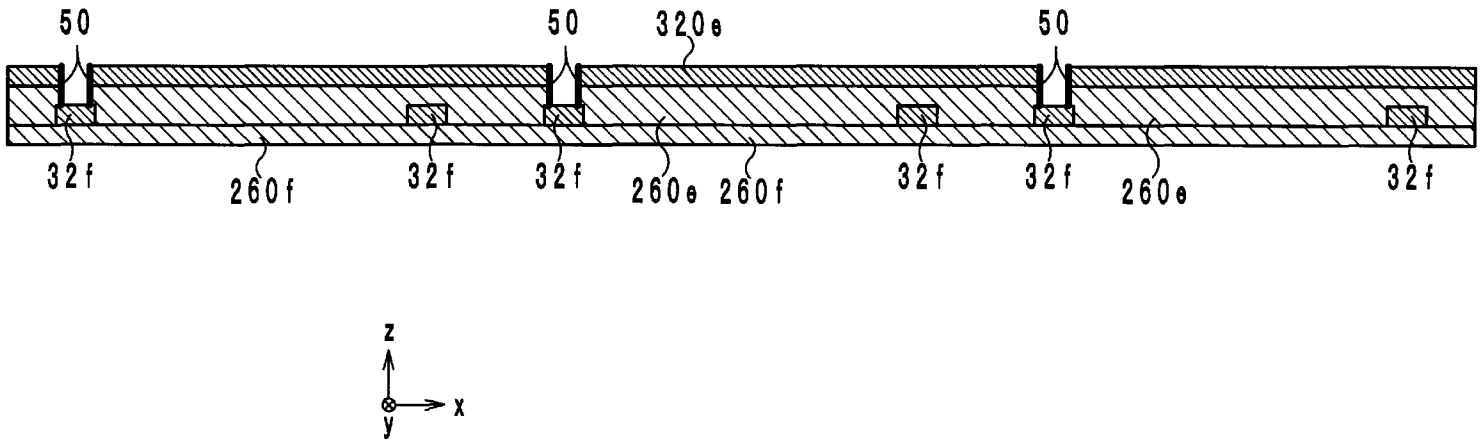
FIG. 14 is a sectional view illustrating a step when the electronic components 10 are manufactured.
Figure 15:
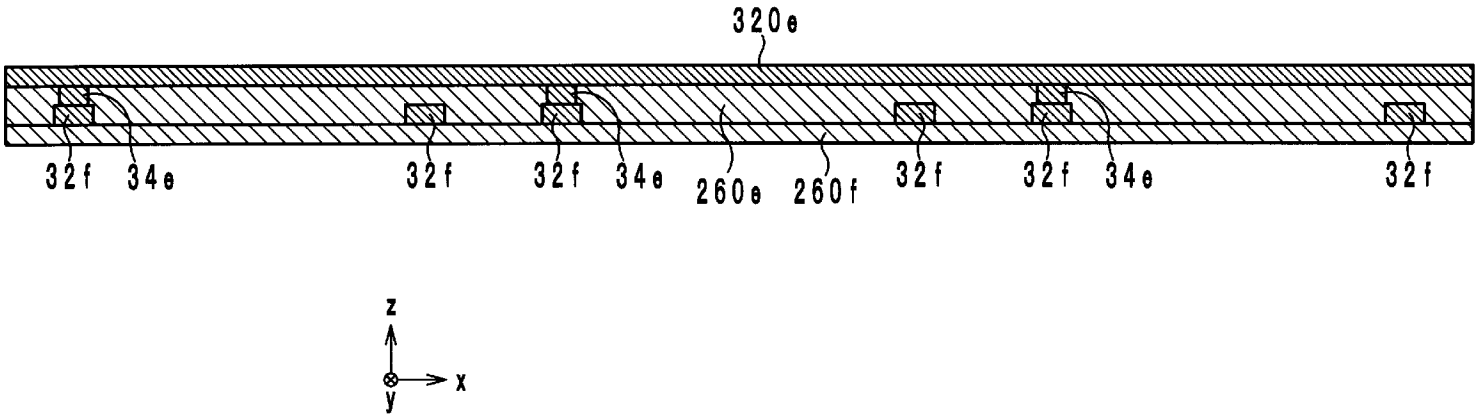
FIG. 15 is a sectional view illustrating a step when the electronic components 10 are manufactured.

The vias are subsequently plated to form via conductors that connect the Cu foil 320*e* and the conductor pattern corresponding to the coil conductors 32*f*. In a step of plating the vias, as illustrated in FIG. 14, seed layers 50 are formed on the inner circumferential surfaces of the respective vias. Electrolytic Cu plating is performed with the seed layers 50 used as bases for electrolytic Cu plating, and the via conductors that connect the Cu foil 320*e* and the conductor pattern corresponding to the coil conductors 32*f*, as illustrated in FIG. 15, are thereby formed. The via conductors formed in this step correspond to the via conductors 34*e*.

Figure 16:
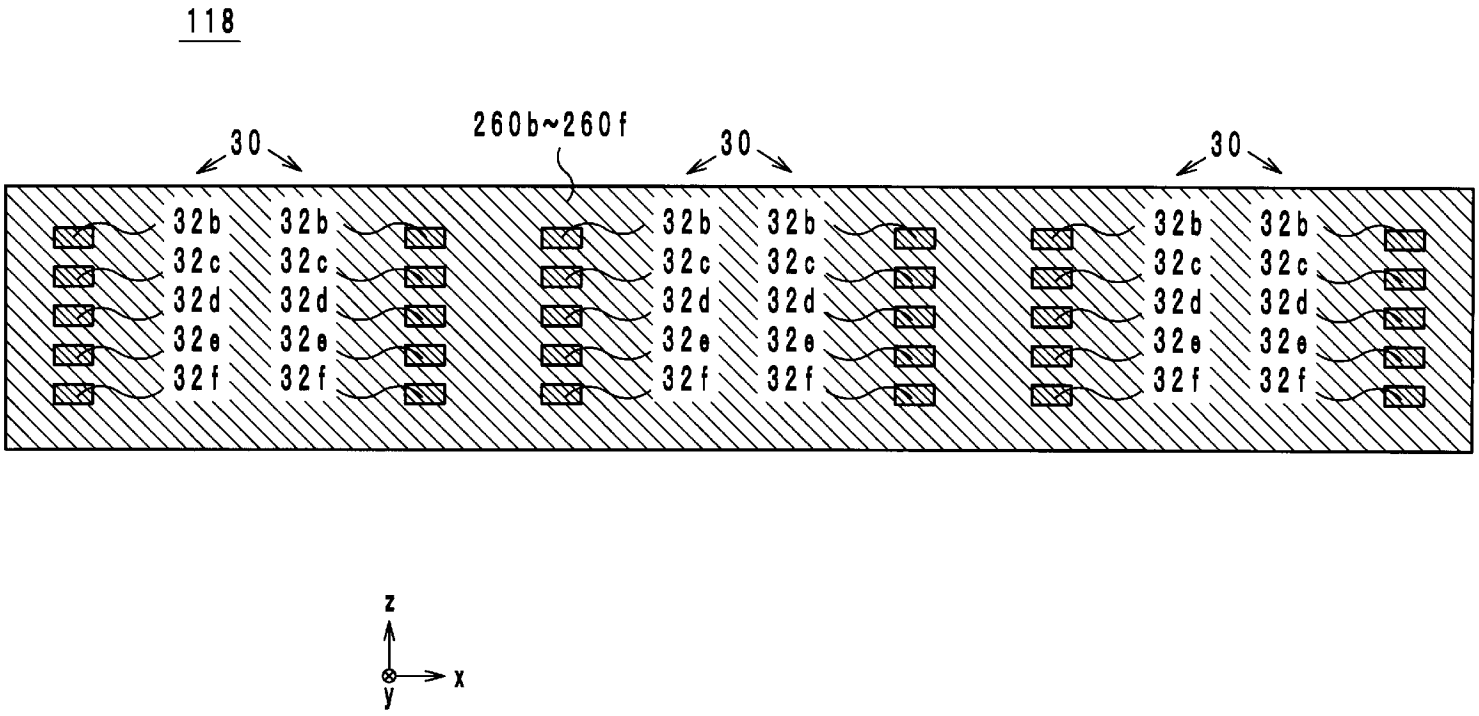
FIG. 16 is a sectional view illustrating a step when the electronic components 10 are manufactured.
Figure 17:
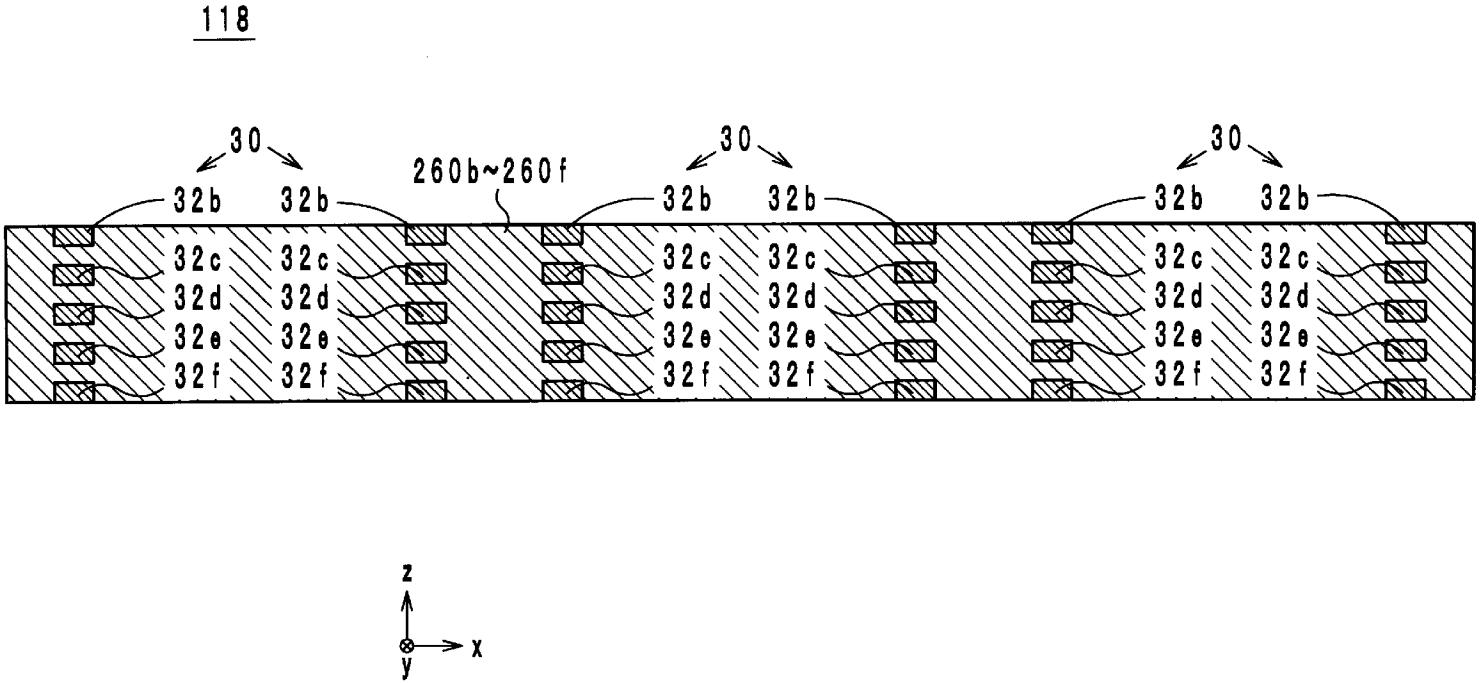
FIG. 17 is a sectional view illustrating a step when the electronic components 10 are manufactured.

After the via conductors are formed, the Cu foil, which is the uppermost surface layer, is etched to form a conductor pattern. A resin sheet to which a Cu foil is bonded by pressure bonding is bonded thereto by pressure bonding. The above steps of forming the vias and the via conductors are repeated. A resin sheet is finally bonded by pressure bonding. In this way, a coil body 118 that is made of a non-magnetic material and includes the coils 30, as illustrated in FIG. 16, is completed. After the coil body 118 is completed, resins on the surfaces of the coil body 118 is removed by buffing, etching, grinding, chemical and mechanical polishing (CMP), or another method in order to flatten the surface of the coil body 118. As illustrated in FIG. 17, the non-magnetic material layers on the upper surface side and lower surface side of each coil 30 in the coil body 118 are thus removed.

Figure 18:
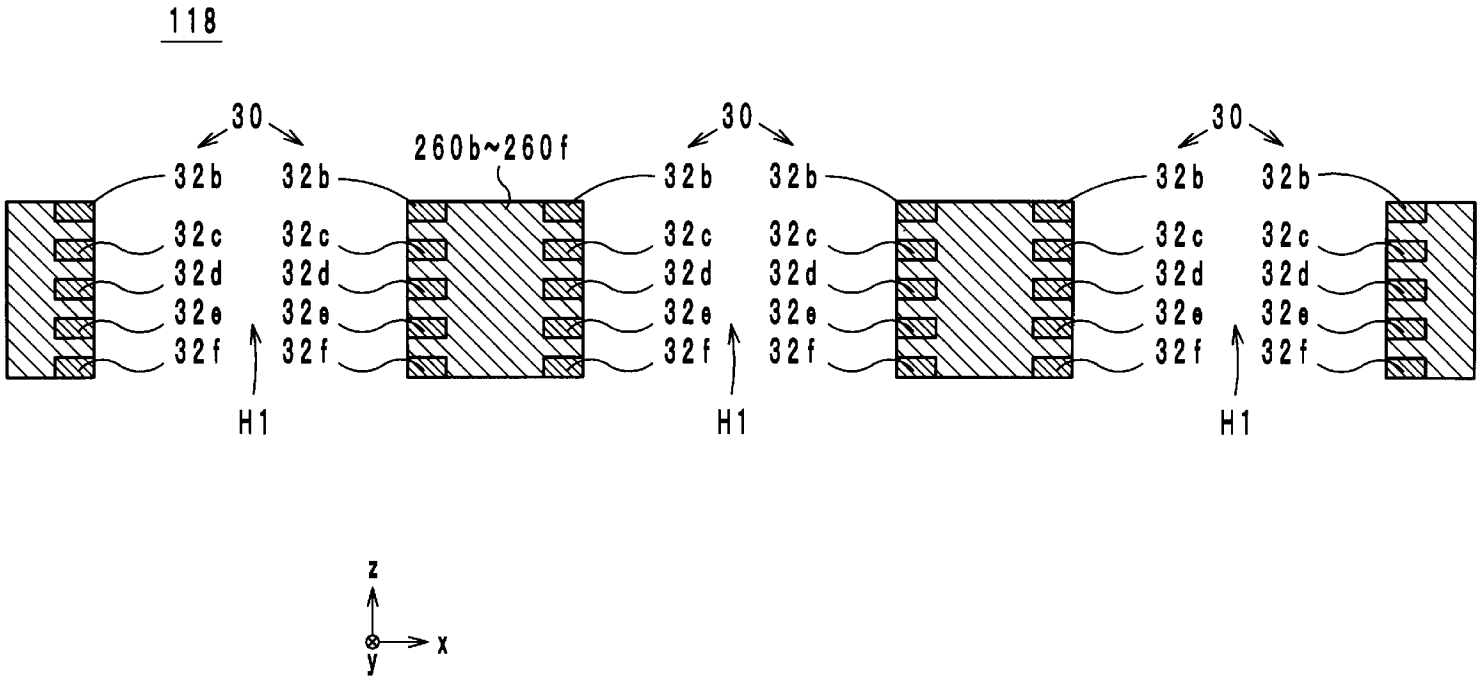
FIG. 18 is a sectional view illustrating a step when the electronic components 10 are manufactured.
Figure 19:
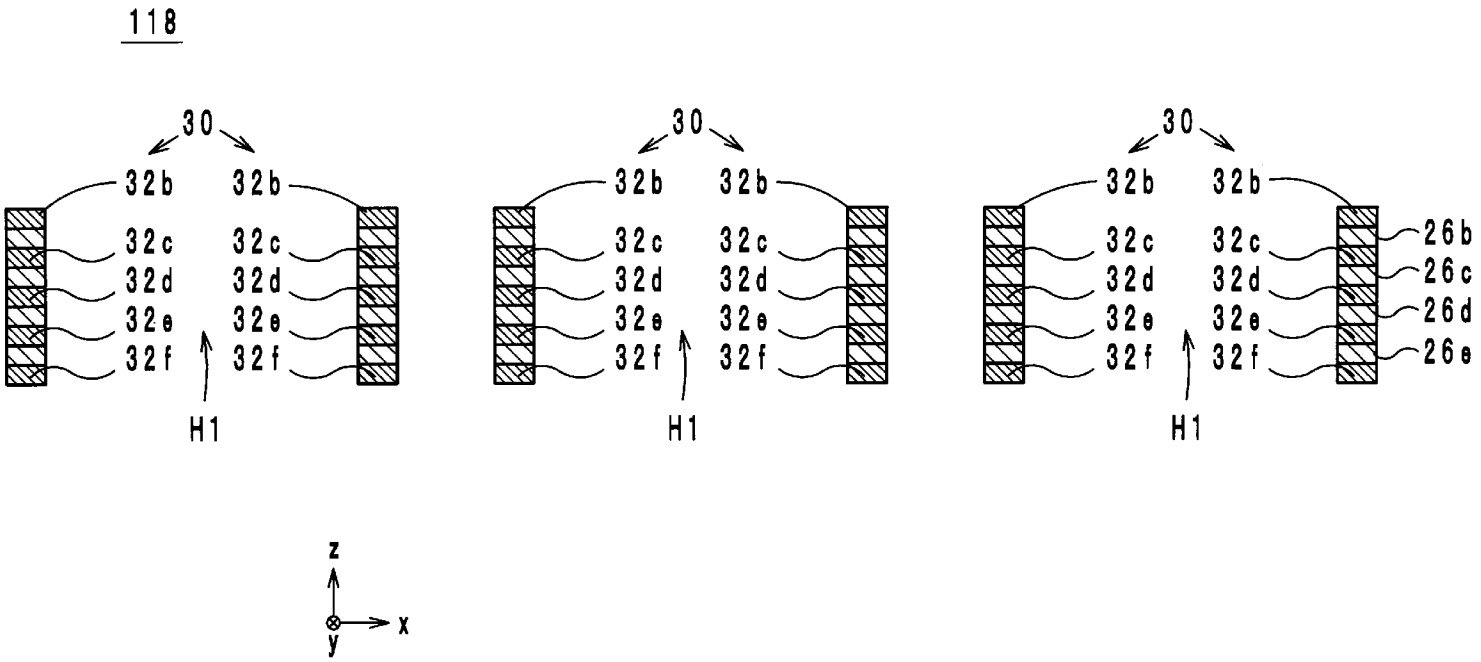
FIG. 19 is a sectional view illustrating a step when the electronic components 10 are manufactured.

As illustrated in FIG. 18, the inner circumferences of the coils 30 located inside the coil body 118 are subsequently sandblasted to form through-holes H1. As illustrated in FIG. 19, resins on the outer circumferential sides of the coils 30 are removed by using, for example, a dicing machine, a laser, a blasting machine. The non-magnetic material layers 26*b* to 26*e* that cover the circumferences of the coils 30 are thus completed. The through-holes may be formed by, for example, a laser or a punching machine.

Figure 20:
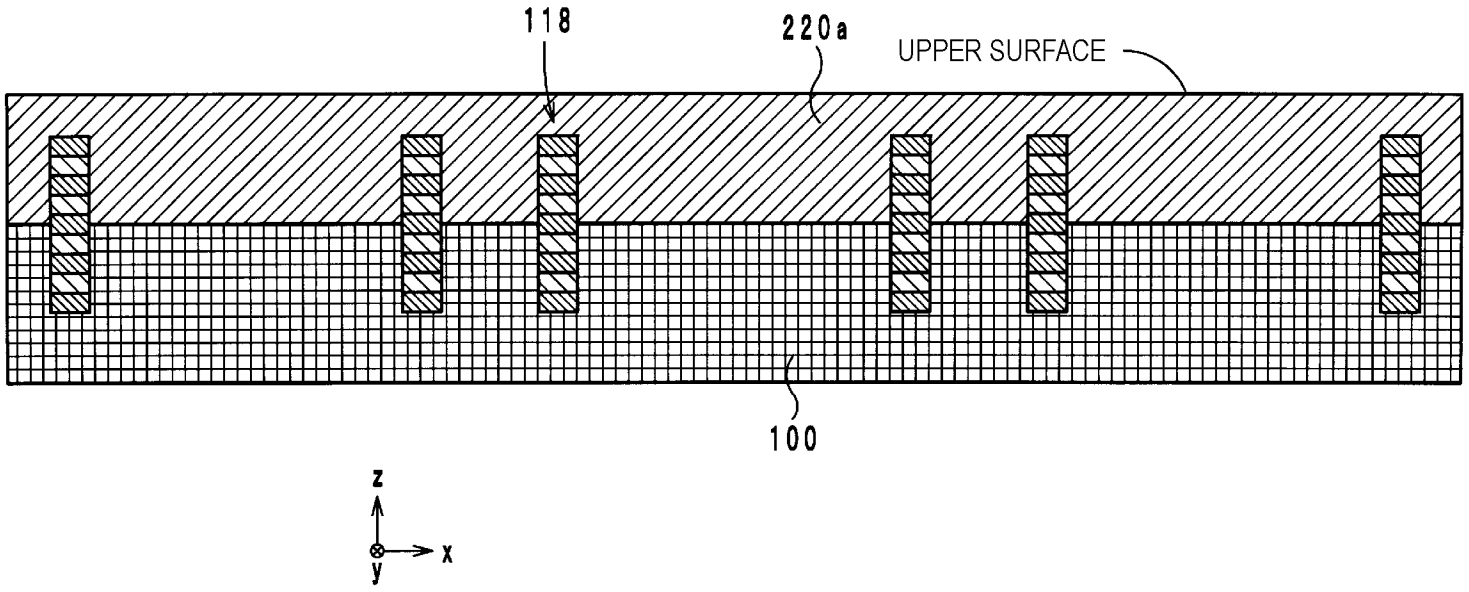
FIG. 20 is a sectional view illustrating a step when the electronic components 10 are manufactured.

As illustrated in FIG. 20, the coil body 118 in which only the coils 30 and the non-magnetic material layers 26*b* to 26*e* are left (hereinafter, simply referred to as the coil body 118) is subsequently set on a mold 100. A resin sheet 220*a* containing particles of the metallic magnetic material is set on the upper surface of the coil body 118 and pressed with the resin sheet 220*a* facing downward. This causes the upper half of the coil body 118 to be buried in the resin sheet 220*a*. Examples of the metallic magnetic material of which the particles contained in the resin sheet 220*a* are made include a metallic magnetic material such as an Fe—Si—Cr alloy and Fe (carbonyl). An example of the main component of the resin is an epoxy resin. The resin sheet 220*a* is made of a magnetic material and will be the insulating layers 22*a* and magnetic material layers 24*b* and 24*c* of the electronic components 10.

Figure 21:
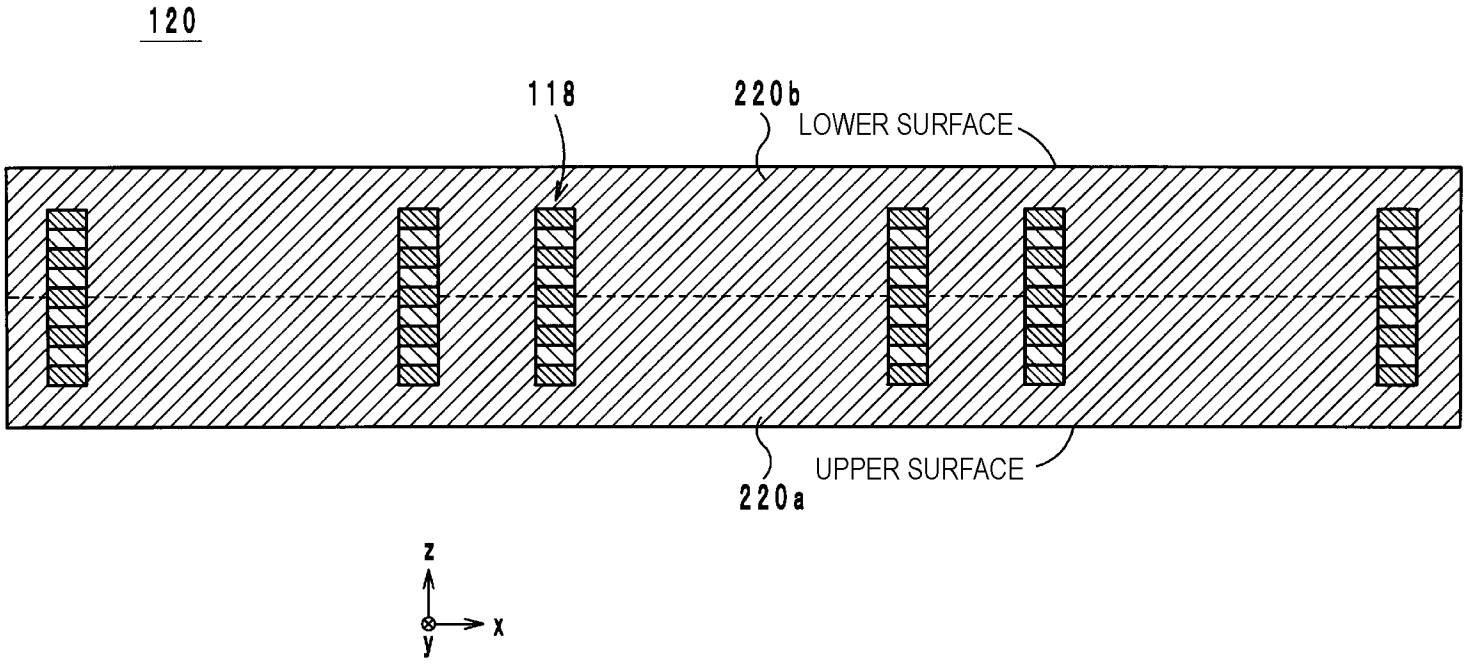
FIG. 21 is a sectional view illustrating a step when the electronic components 10 are manufactured.

As illustrated in FIG. 21, the coil body 118 whose upper half has been buried in the resin sheet 220*a* is subsequently turned upside down. A resin sheet 220*b* containing particles of the metallic magnetic material is set on the upper surface of the coil body 118 whose upper half has been buried in the resin sheet 220*a* and pressed with the resin sheet 220*b* facing downward. This causes the lower half of the coil body 118 to be buried in the resin sheet 220*b*. Examples of the metallic magnetic material of which the particles contained in the resin sheet 220*b* are made include a metallic magnetic material such as an Fe—Si—Cr alloy and Fe (carbonyl). An example of the main component of the resin is an epoxy resin. The resin sheet 220*b* is made of a magnetic material and will be the insulating layers 22*f* and magnetic material layers 24*d* to 24*e* of the electronic components 10. A heat treatment is then performed, for example, at temperatures of 130 to 200° C. for 10 to 120 minutes by using a high-temperature chamber such as an oven. A mother multilayer body 120 is thereby completed. In the mother multilayer body 120, a plurality of the multilayer bodies 20 are disposed in a matrix arrangement in plan view from the z-axis direction.

Figure 22:
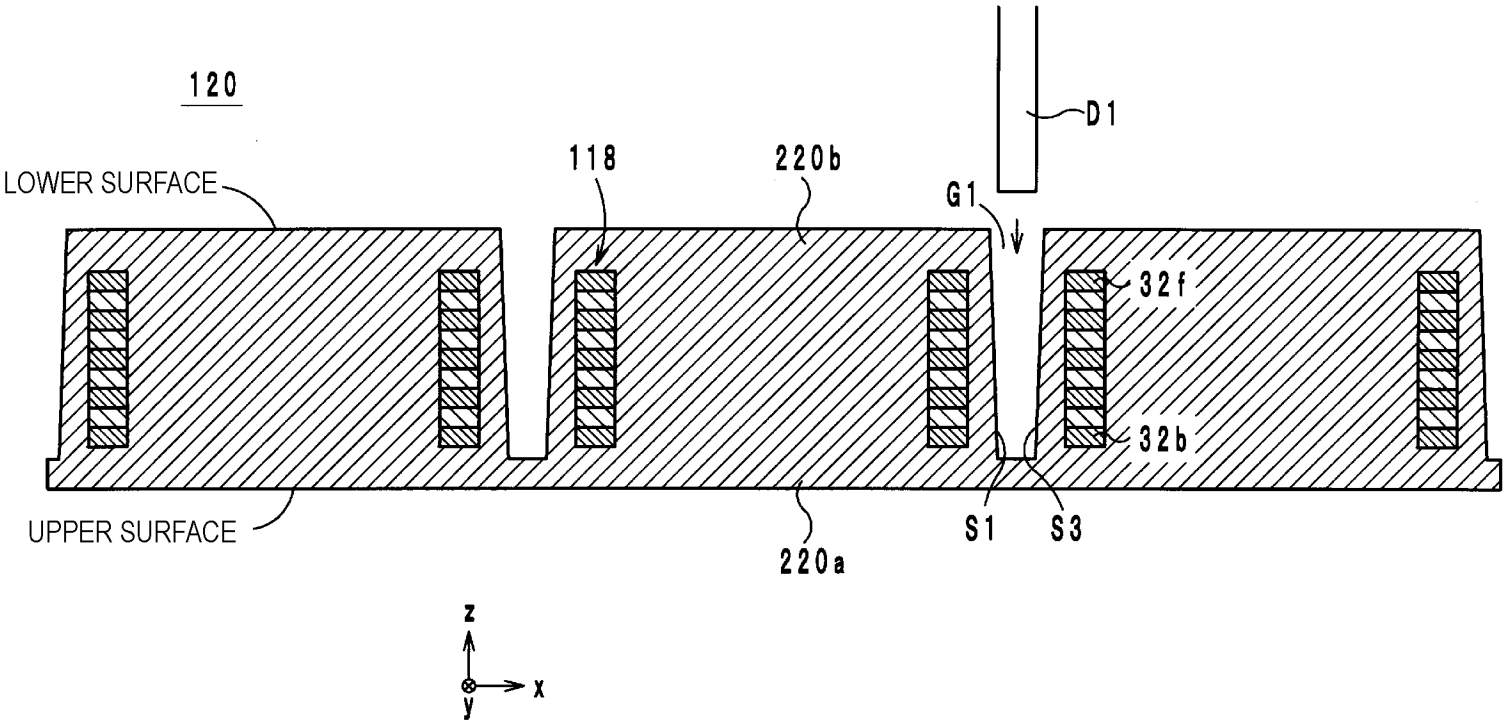
FIG. 22 is a sectional view illustrating a step when the electronic components 10 are manufactured.

As illustrated in FIG. 22, in the lower surface (one main surface) of the mother multilayer body 120, grooves G1 that do not reach the upper surface (the other surface) of the mother multilayer body 120 are subsequently formed with a dicing machine D1. More specifically, the grooves G1 are formed in a manner in which the boundaries between the multilayer bodies 20 in the mother multilayer body 120 that are adjacent to each other in the x-axis direction are cut with the dicing machine D1. The grooves G1 are hollowed from the lower surface of the mother multilayer body 120 toward the upper surface side of the mother multilayer body 120. In plan view from the z-axis direction, the grooves G1 extend along the boundaries between the multilayer bodies 20 in the y-axis direction. A bottom portion of each groove G1 reaches a position away from the corresponding coil conductor 32*b* toward the upper surface side. Parts (contact portions S1 and S3) of both end surfaces of each multilayer body in the x-axis direction are thus formed. Parts of the particles of the metallic magnetic material that are located at the contact portions S1 and S3 of each multilayer body 20 are cut to expose the particles of the metallic magnetic material from the contact portions S1 and S3 of each multilayer body 20 to the outside. The one end of each coil conductor 32*b* is exposed from the corresponding contact portion S1, and the other end of each coil conductor 32*f* is exposed from the corresponding contact portion S3.

Figure 23:
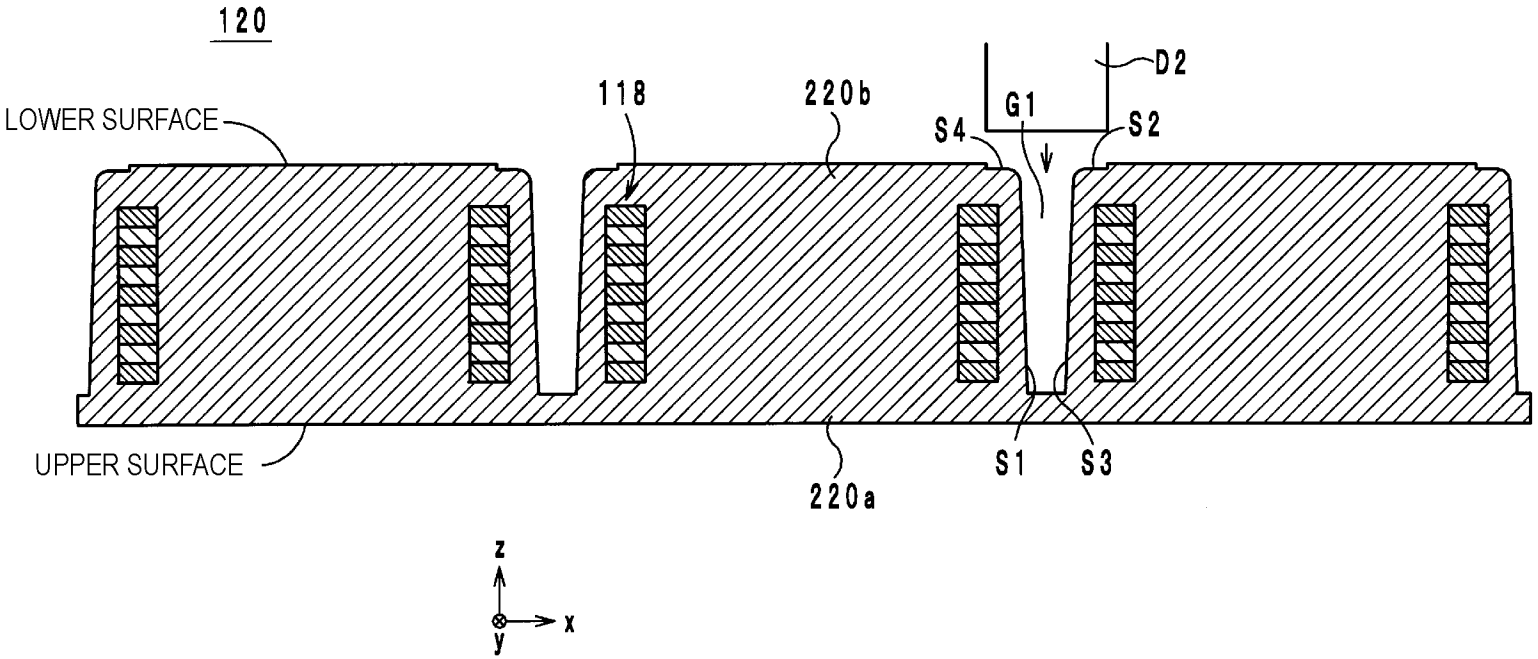
FIG. 23 is a sectional view illustrating a step when the electronic components 10 are manufactured.

As illustrated in FIG. 23, portions of the lower surface of the mother multilayer body 120 that are adjacent to the corresponding groove G1 are subsequently cut with a dicing machine D2. More specifically, portions corresponding to the contact portions S2 and S4 are slightly cut with the dicing machine D2. The contact portions S2 and S4 are thus formed on each multilayer body 20. Parts of the particles of the metallic magnetic material that are located at the contact portions S2 and S4 of each multilayer body 20 are cut to expose the particles of the metallic magnetic material from the contact portions S2 and S4 of each multilayer body 20 to the outside.

Figure 24:
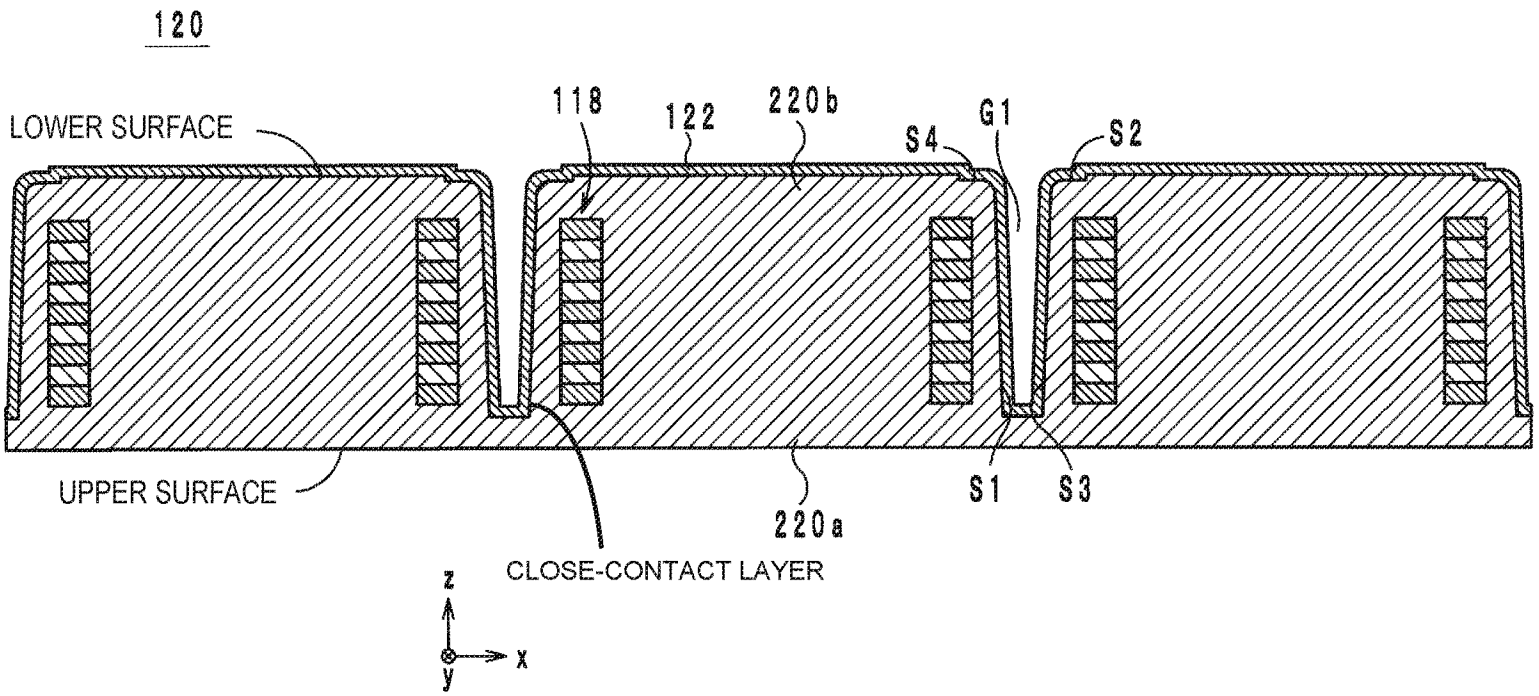
FIG. 24 is a sectional view illustrating a step when the electronic components 10 are manufactured.

As illustrated in FIG. 24, a Cu film 122 is subsequently formed by electrolytic Cu plating so as to cover the lower surface of the mother multilayer body 120 and the inner circumferential surfaces (that is, the contact portions S1 and S3) of the grooves G1. The electrolytic Cu plating is performed in a constant current mode. The main component of a plating bath is a copper sulfate solution. Right before plating, an immersing process may be performed by using an acid cleaner in order to remove an oxide film on the Cu film 122 and to ensure adhesion. After electrolytic Cu plating, rinsing and drying are performed to remove a plating solution. After electrolytic Cu plating, a heat treatment is preferably performed to suppress warping of the mother multilayer body 120. More specifically, the heat treatment is performed at temperatures of 150 to 250° C. for 60 to 180 minutes by using a high-temperature chamber such as an oven.

Figure 25:
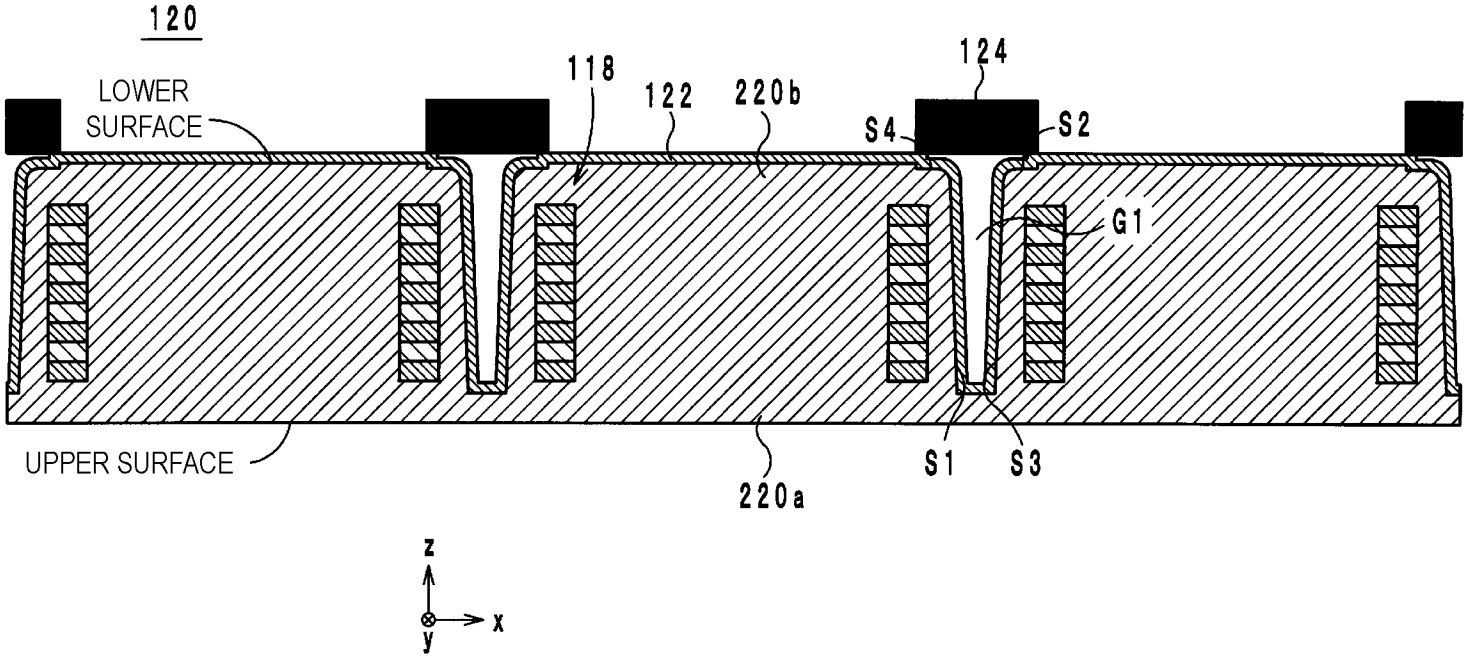
FIG. 25 is a sectional view illustrating a step when the electronic components 10 are manufactured.

As illustrated in FIG. 25, resists 124 are subsequently formed so as to cover the grooves G1 and the contact portions S2 and S4. More specifically, before the resists 124 are formed, the surface of the Cu film 122 is preferably roughened in order to improve adhesion between the resists 124 and the Cu film 122. Examples of the roughing process include milling, etching, and buffing. Buffing is advantageous in that a large area can be uniformly processed in a short time. After the mother multilayer body 120 is rinsed and dried, the resists 124 are formed. The resists 124 are formed by performing resist laminating, pattern exposing, and developing in this order. In resist laminating, a film resist is used. In pattern exposing, a film mask is used. In developing, sodium carbonate is used as a developing solution. After developing, the mother multilayer body 120 is rinsed and dried.

Figure 26:
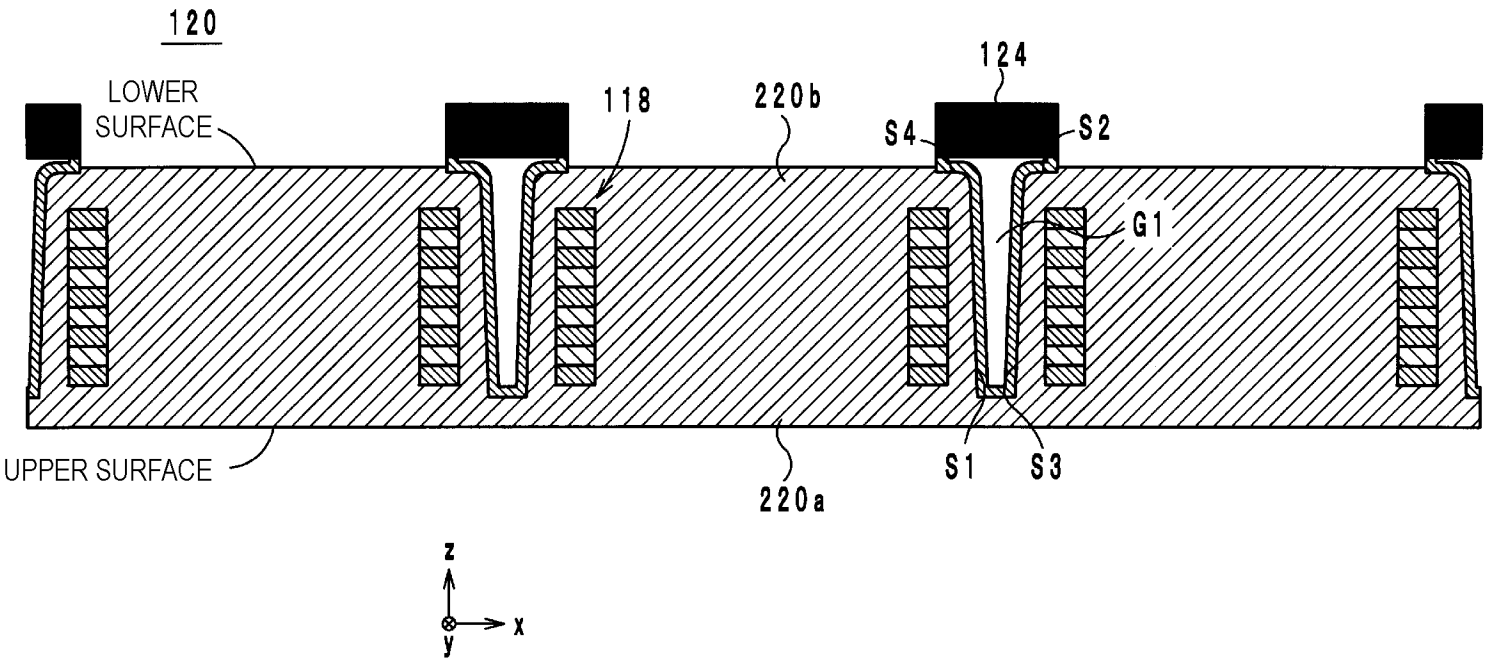
FIG. 26 is a sectional view illustrating a step when the electronic components 10 are manufactured.

As illustrated in FIG. 26, portions of the Cu film 122 that are not covered by the resists 124 are subsequently removed by etching. The etching is performed by, for example, wet etching or milling. Wet etching is advantageous in a large etching rate and easiness of entering into, for example, a gap. After wet etching, the mother multilayer body 120 is rinsed to remove liquid residues.

Figure 27:
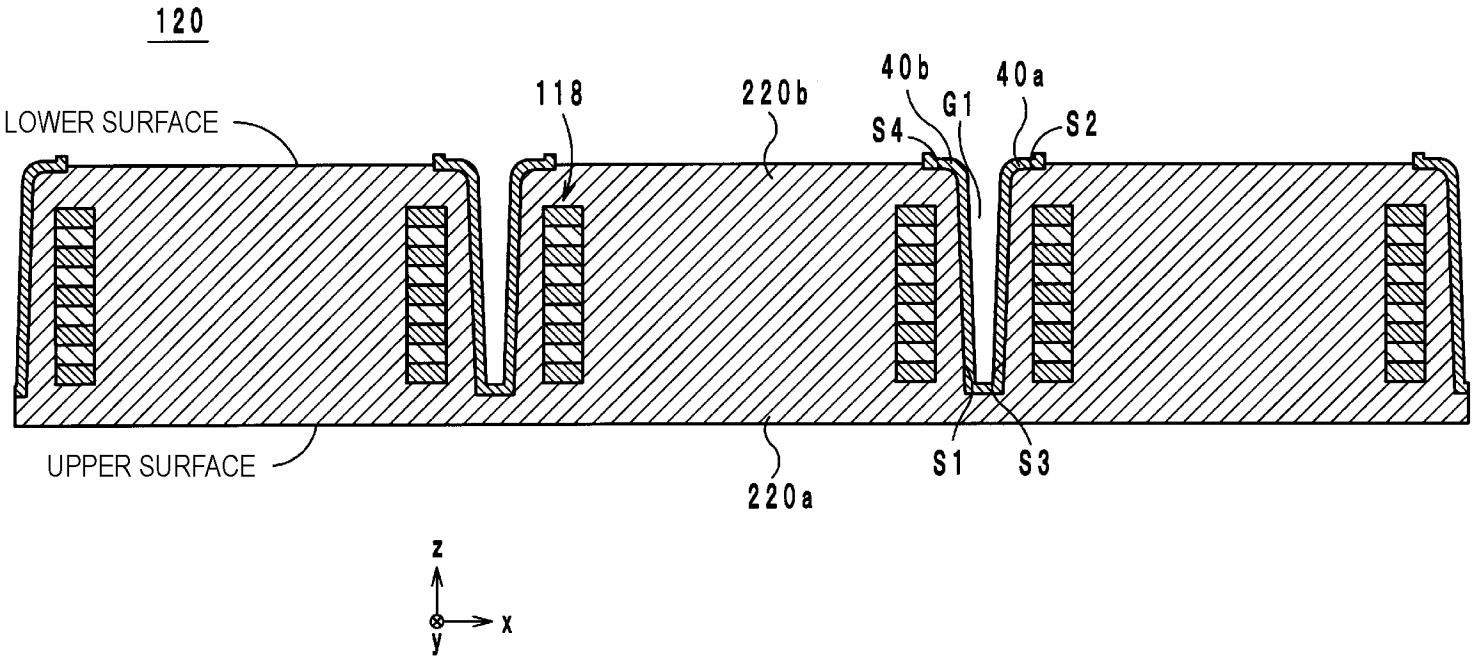
FIG. 27 is a sectional view illustrating a step when the electronic components 10 are manufactured.

As illustrated in FIG. 27, the mother multilayer body 120 is subsequently immersed into a stripping solution and the resists 124 are removed. The mother multilayer body 120 is then rinsed to remove liquid residues. Through the above steps, the outer electrode 40*a* covering the contact portions S1 and S2 and the outer electrode 40*b* covering the contact portions S3 and S4 are formed.

Finally, the mother multilayer body 120 is divided into the multilayer bodies 20 with a dicing machine. After the mother multilayer body 120 is divided, barrel polishing is performed. Nickel plating and tin plating may be performed on the surfaces of underlying electrodes of the outer electrodes 40*a* and 40*b* by barrel plating. Through the above steps, the electronic components 10 are completed.

(Effect)

With the electronic component 10 configured as above and the method of manufacturing the electronic components 10, the adhesion between the multilayer body 20 and the outer electrodes 40*a* and 40*b* can be improved. More specifically, the multilayer body 20 is made of a material containing particles of the metallic magnetic material. The outer electrode 40*a* is formed on the contact portions S1 and S2 at which the particles of the metallic magnetic material are exposed. The outer electrode 40*b* is formed on the contact portions S3 and S4 at which the particles of the metallic magnetic material are exposed. The outer electrodes 40*a* and 40*b* are each made of a metal and hence metallically firmly bonded to the particles of the metallic magnetic material. For this reason, the outer electrodes 40*a* and 40*b* are in very close contact with the multilayer body 20 due to an anchor effect.

When the outer electrodes 40*a* and 40*b* are in very close contact with the multilayer body 20, it is not necessary to increase the size of the outer electrodes 40*a* and 40*b* in order to increase the adhesion between the outer electrodes 40*a* and 40*b* and the multilayer body 20. Consequently, the outer electrodes 40*a* and 40*b* can be downsized and the electronic component 10 can be downsized.

The contact portions S1 to S4 are portions at which the particles of the metallic magnetic material are exposed from the surfaces of the multilayer body 20. Accordingly, in the case where the Cu film 122 is formed by plating, the film thickness of the Cu film 122 at the contact portions S1 to S4 can be larger than the film thickness of the Cu film 122 at portions other than the contact portions S1 to S4, although this is not represented in FIG. 24. This enables the Cu film 122 with a sufficient film thickness to be formed in a short time at positions at which the outer electrodes 40*a* and 40*b* are to be formed. Since only thin Cu film 122 is formed at positions at which the outer electrodes 40*a* and 40*b* are not formed, an excess of the Cu film 122 can be removed in a short time by etching. Thus, the time required for forming the Cu film 122 can be reduced, and the time required for etching the Cu film 122 can be reduced.

At the contact portions S1 to S4, the particles of the metallic magnetic material are exposed. This enables the outer electrodes 40*a* and 40*b* to be made by plating. Thus, the outer electrodes 40*a* and 40*b* can be made of only a material having a low resistivity such as Cu, Ag, or Au. In other words, it is not necessary to provide a close-contact layer, as an underlying layer of the Cu film 122, for improving the adhesion between the outer electrodes 40*a* and 40*b* and the multilayer body 20 nor to add glass to the outer electrodes 40*a* and 40*b*. The close-contact layer is made of a material having a high resistivity such as Ti, Cr, or NiCr. In the case where glass is added to the outer electrodes 40*a* and 40*b*, the resistivity of the outer electrodes 40*a* and 40*b* is high. Thus, with the electronic component 10, the resistivity of the outer electrodes 40*a* and 40*b* can be reduced. However, this does not prevent the close-contact layer from being provided nor prevent glass from being added to the outer electrodes 40*a* and 40*b*.

Since the outer electrodes 40*a* and 40*b* are in contact with the particles of the metallic magnetic material, the resistivity of the outer electrodes 40*a* and 40*b* is reduced.

The outer electrodes 40*a* and 40*b* extend into the bottom surface and respective end surfaces of the multilayer body 20. With this structure of the electronic component 10, the adhesion between the outer electrodes 40*a* and 40*b* and the multilayer body can be improved compared with the case where the outer electrodes 40*a* and 40*b* are disposed on either the bottom surface or the end surfaces.

Other Embodiment

The electronic component and method of manufacturing the electronic component according to the present disclosure are not limited to the electronic component 10 and the method of manufacturing the electronic components 10 and can be modified within the range of the concept of the present disclosure.

Although it is described that the outer electrodes 40*a* and 40*b* are made by plating, the outer electrodes 40*a* and 40*b* may be formed by printing or dipping an Ag paste containing a resin paste and glass. The outer electrodes 40*a* and 40*b* may also be formed by a thin-film forming method such as vapor deposition or sputtering.

When the mother multilayer body 120 is divided into the multilayer bodies 20, the mother multilayer body 120 is cut with a dicing machine. The mother multilayer body 120, however, may be divided by blasting or laser processing.

The multilayer body 20 may be made of an inorganic oxide (glass) containing particles of the metallic magnetic material. That is, the multilayer body 20 only needs to be made of an insulating material containing particles of the metallic magnetic material.

The particles of the metallic magnetic material may be exposed from the entire surface of the multilayer body 20 to the outside. From the perspective of insulation performance, however, the particles of the metallic magnetic material are preferably exposed at only the contact portions S1 to S4 to the outside.

The electronic component 10 may be manufactured by molding a resin containing particles of the metallic magnetic material, and a coil including a rectangular wire helically wound.

Although the electronic component 10 includes the coil 30, a circuit element (for example, a condenser, a resistance, or another circuit element) other than a coil may be included.

In the electronic component 10, the particles of the metallic magnetic material may be exposed by polishing the contact portions S1 to S4.

The outer electrodes 40*a* and 40*b* may include a close-contact layer as an underlying layer of a conductor layer made of only a material having a low resistivity such as Cu, Ag, or Au. The close-contact layer is a conductor layer for improving the adhesion between the outer electrodes 40*a* and 40*b* and the multilayer body 20. The close-contact layer is made of a material having a high resistivity such as Ti, Cr, NiCr, NiCu, or an alloy thereof.

INDUSTRIAL APPLICABILITY

Thus, the present disclosure is useful for an electronic component and a method of manufacturing the electronic component and is advantageous in that adhesion between a body and an outer electrode can be improved.

The invention claimed is:

1. An electronic component, comprising:

a body made of a material containing particles of a metallic magnetic material; and an outer electrode disposed on a surface of the body, wherein, the surface of the body has a contact portion which is in direct contact with the outer electrode, and the contact portion includes particles of the metallic magnetic material which are exposed from the surface of the body, surfaces of the particles of the metallic magnetic material are coated with respective insulating films, and at the contact portion, the insulating films are removed to expose the particles of the metallic magnetic material.

2. The electronic component according to claim 1, wherein the particles of the metallic magnetic material at the contact portion are exposed through forming the contact portion by cutting.

3. The electronic component according to claim 1, wherein the body has a rectangular cuboid shape and has a mounting surface that is to face a circuit board in a mounting process, and opposing first and second end surfaces adjacent to the mounting surface, and wherein the outer electrode extends into at least one of the mounting surface and the first end surface.

4. The electronic component according to claim 1, wherein the outer electrode includes a close-contact layer made of Ti, Cr, or Ni.

5. The electronic component according to claim 1, wherein the outer electrode is made of Cu, Ag, or an alloy of Cu and Ag.

6. The electronic component according to claim 1, further comprising:

a circuit element mounted in the body and electrically connected to the outer electrode.

* * * * *